US009768494B2

(12) United States Patent
Johansson et al.

(10) Patent No.: US 9,768,494 B2
(45) Date of Patent: Sep. 19, 2017

(54) ANTENNA WITH ADJUSTABLE BEAM CHARACTERISTICS

(75) Inventors: Stefan Johansson, Romelanda (SE); Martin Johansson, Molndal (SE); Sven Oscar Petersson, Savedalen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 1322 days.

(21) Appl. No.: 13/577,605

(22) PCT Filed: Feb. 8, 2010

(86) PCT No.: PCT/EP2010/000756

§ 371 (c)(1),
(2), (4) Date: Aug. 7, 2012

(87) PCT Pub. No.: WO2011/095184

PCT Pub. Date: Aug. 11, 2011

(65) Prior Publication Data

US 2012/0319900 A1 Dec. 20, 2012

(51) Int. Cl.
*H01Q 3/00* (2006.01)
*H01Q 1/24* (2006.01)
(Continued)

(52) U.S. Cl.
CPC ..... *H01Q 1/246* (2013.01); *H01Q 3/26* (2013.01); *H01Q 21/26* (2013.01); *H01Q 21/29* (2013.01); *H01Q 3/267* (2013.01); *H01Q 25/001* (2013.01)

(58) Field of Classification Search
CPC ..... H01C 1/246; H01C 25/001; H01C 21/26; H01C 21/29; H01C 3/26; H01C 3/267
(Continued)

(56) References Cited

U.S. PATENT DOCUMENTS 5,686,926 A * 11/1997 Kijima ..... H01Q 25/00 342/371
6,680,698 B2 * 1/2004 Eiges ..... H01Q 1/28 342/361

(Continued)

FOREIGN PATENT DOCUMENTS

| | | | |
|---|---|---|---|
| EP | 1 923 954 | A1 | 5/2008 |
| JP | 2008-124974 | A | 5/2008 |
| WO | 2008060206 | A1 | 5/2008 |

OTHER PUBLICATIONS

Notice of Preliminary Rejection (Non-Final) in related Korean Patent Application No. 10-2012-7020773, dated Jan. 29, 2016, 3 pages.

*Primary Examiner* — Chuong P Nguyen
(74) *Attorney, Agent, or Firm* — Rothwell, Figg, Ernst & Manbeck, P.C.

(57) ABSTRACT

The present invention relates to an antenna comprising multiple array elements with a first and second feeding point, each associated with orthogonal polarizations, each array element has a first and second phase centre each associated with the orthogonal polarizations, the first and second phase centres of said array elements are arranged in at least two columns, and one antenna port connected to the first and second feeding points of at least two array elements with first phase centre and second phase centre arranged in the at least two columns via a respective feeding network. The feeding network comprises a beam forming network having a primary connection, connected to the antenna port, and at least four secondary connections. The beam forming network divides power between the first feeding point and the second feeding point and controls phase shift differences between the respective feeding points with phase centre arranged in different columns.

19 Claims, 14 Drawing Sheets

(51) Int. Cl.

| | |
|---|---|
| ***H01Q 21/26*** | (2006.01) |
| ***H01Q 21/29*** | (2006.01) |
| *H01Q 3/26* | (2006.01) |
| *H01Q 25/00* | (2006.01) |

(58) Field of Classification Search
USPC ..... 342/368
See application file for complete search history.

(56) References Cited

U.S. PATENT DOCUMENTS

| | | | | |
|---|---|---|---|---|
| 6,801,160 | B2 * | 10/2004 | Henderson | H01Q 1/246 342/372 |
| 7,817,096 | B2 * | 10/2010 | Linehan | H01Q 1/246 343/757 |
| 8,260,336 | B2 * | 9/2012 | Johansson | H01Q 1/005 342/372 |
| 8,588,334 | B2 * | 11/2013 | McGowan | H01Q 1/246 330/84 |
| 8,988,302 | B2 * | 3/2015 | Petersson | H01Q 21/24 343/756 |
| 9,264,114 | B2 * | 2/2016 | Petersson | H01Q 1/246 |
| 9,537,214 | B2 * | 1/2017 | Corman | H01Q 3/34 |
| 2002/0080073 | A1 * | 6/2002 | Wastberg | H01Q 1/246 343/700 MS |
| 2004/0077379 | A1 | 4/2004 | Smith et al. | |
| 2006/0068848 | A1 | 3/2006 | Shapira et al. | |
| 2008/0111740 | A1 * | 5/2008 | Hirabe | H01Q 1/246 342/361 |
| 2009/0010356 | A1 * | 1/2009 | Engstrom | H04B 7/0617 375/267 |
| 2009/0322608 | A1 * | 12/2009 | Adams | H01Q 1/246 342/368 |
| 2010/0261440 | A1 * | 10/2010 | Corman | H01Q 3/26 455/91 |
| 2011/0205119 | A1 * | 8/2011 | Timofeev | H01Q 1/246 342/373 |
| 2012/0064825 | A1 * | 3/2012 | Landon | H04B 7/10 455/39 |
| 2013/0281159 | A1 * | 10/2013 | Ai | H01Q 3/26 455/562.1 |

* cited by examiner

ANTENNA WITH ADJUSTABLE BEAM CHARACTERISTICS

CROSS REFERENCE TO RELATED APPLICATION(S)

This application is a 35 U.S.C. §371 National Phase Entry Application from PCT/EP2010/000756, filed Feb. 8, 2010, designating the United States, the disclosure of which is incorporated by reference herein in its entirety.

TECHNICAL FIELD

The present invention relates to an antenna with adjustable beam characteristics, such as beam width and beam pointing. The invention also relates to a communication device and communication system provided with such an antenna.

BACKGROUND

Almost all base station antennas used for mobile communication up till now have, by design, more or less fixed characteristics. One exception is electrical beam tilt which is a frequently used feature. In addition some products exist for which beam width and/or direction can be changed.

Deploying antennas where characteristics (parameters) can be changed, or adjusted, after deployment is of interest since they make it possible to:

- Tune the network by changing parameters on a long term basis
- Tune the network on a short term basis, for example to handle variations in traffic load over twenty-four hours.

Thus, there is a need to be able to adjust beam width and to adjust beam pointing direction to achieve these features.

Current implementations of these features are based on mechanically rotating or moving parts of the antenna which results in relatively complicated mechanically designs.

SUMMARY OF THE INVENTION

An object with the present invention is to provide an antenna with adjustable beam characteristics that is more flexible and have a simpler design compared to prior art solutions.

This object is achieved by an antenna with adjustable beam characteristics comprising: multiple array elements, each array element comprises a first feeding point associated with a first polarization and a second feeding point associated with a second polarization, orthogonal to the first polarization, each array element having a first phase centre associated with the first polarization and a second phase centre associated with the second polarization, the first and second phase centres of the array elements are arranged in at least two columns, and one or more antenna ports, each antenna port is connected to the first and second feeding points of at least two array elements with first phase centre and second phase centre arranged in the at least two columns via a respective feeding network. The respective feeding network comprises a beam forming network having a primary connection, connected to a respective antenna port, and at least four secondary connections, the beam forming network is configured to divide power between the first feeding point and the second feeding point of the connected array elements, and to control phase shift differences between the first feeding points of connected array elements with the phase centre arranged in different columns and between the second feeding points of connected array elements with the second phase centre arranged in different columns.

An advantage with the present invention is that an antenna with adjustable beam width and/or beam pointing may be achieved. The beam width and/or beam pointing can be controlled by simple variable phase shifters. The variable phase shifter can for instance be based on similar technology that has been frequently used in base station antennas for the purpose of remote electrical tilt control.

Further objects and advantages may be found by a skilled person in the art from the detailed description.

BRIEF DESCRIPTION OF DRAWINGS

The invention will be described in connection with the following drawings that are provided as non-limited examples, in which.

DETAILED DESCRIPTION

Figure 1:
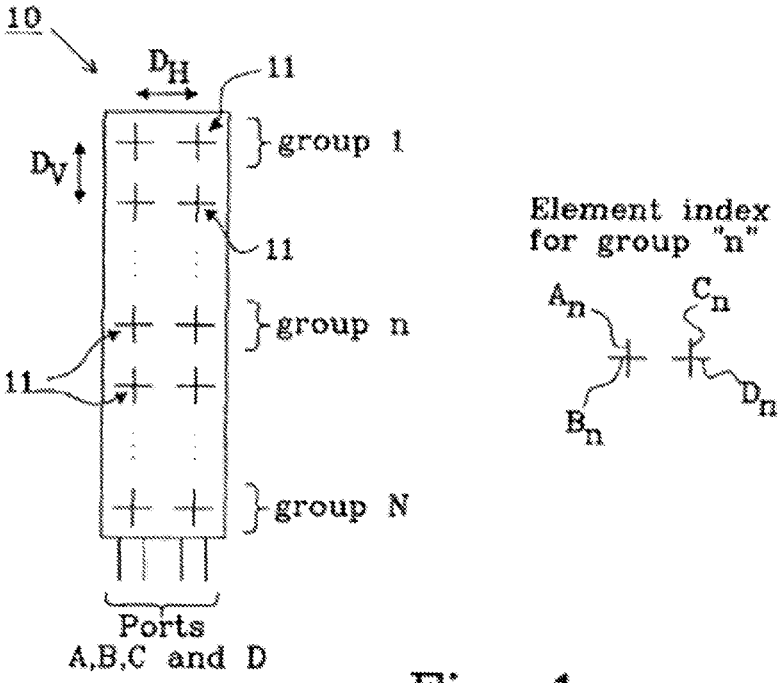
FIG. 1 shows a first antenna configuration which may be used to implement the present invention.

The basic concept of the invention is an antenna with adjustable beam width and/or beam pointing. The antenna comprises multiple dual polarized array elements, each having a first feeding point associated with a first polarization and a second feeding point associated with a second polarization, which is orthogonal to the first polarization. Each array element has two phase centers, a first associated with the first polarization and a second associated with the second polarization. The first phase centre and second phase centre may coincide or differ dependent on the actual array element configuration.

A phase centre is defined as: "The location of a point associated with an antenna such that, if it is taken as the centre of a sphere whose radius extends into the farfield, the phase of a given field component over the surface of the radiation sphere is essentially constant, at least over that portion of the surface where the radiation is significant", see IEEE Standard Definitions of Terms For Antennas, IEEE Std 145-1993 (ISBN 1-55937-317-2).

In the following illustrative examples, the first and second phase centres of the multiple array elements are arranged in at least two columns in such a way that a distance between the first phase centres arranged in different columns preferably is greater than 0.3 wavelengths of the signal transmitted/received using the present invention, and more preferably greater than 0.5 wavelengths. The same applies for the second phase centres arranged in different columns. For each column, at least one feeding points associated with the same polarization are connected via a distribution network resulting in at least one linear array per column when dual polarized array elements are used.

The linear arrays of the same polarization but from different columns are combined via a phase shifter and power dividing device. The phase shifter and power dividing device splits the power with a variable relative phase difference. This results in one or more beam ports for each polarization where the horizontal beam pointing for a beam can be controlled by the variable phase difference of the phase shifter and power dividing device associated with the beam port. At least one of the beams has one polarization and at least one of the beams have a second polarization orthogonal to the first polarization.

Beam ports of the orthogonal polarizations are combined in pairs giving an antenna with one or more antenna ports. By this technique the beam width and beam pointing of beams associated with the one or more antenna ports can be controlled by varying the relative phase difference on the phase shifter and power dividing devices.

In the following, array elements are illustrated as dual polarized radiating elements, or two single polarized elements with orthogonal polarizations, arranged in one or two columns with a column separation and a row separation. These embodiments fulfill the requirement of arranging the first phase centres and the second phase centres in at least two columns, even though this is not explicitly stated in the description of each embodiment.

FIG. 1 shows an antenna configuration (to the left) with N groups of array elements, each with two dual polarized radiating elements. To the right is shown indexing of the radiating elements within a group "n". The elements are arranged to form four linear arrays, each connected to a port A-D. In this embodiment, each dual polarized array elements 11 has a first phase centre associated with a first polarization, e.g. vertical polarization, and a second phase centre associated with a second polarization, i.e. horizontal polarization if the first polarization is vertical. All array elements are in this embodiment identical and the first phase centre of the array elements 11 are arranged in two columns and the second phase centre of the array elements 11 are also arranged in two columns, each column containing N array elements.

Figure 2:
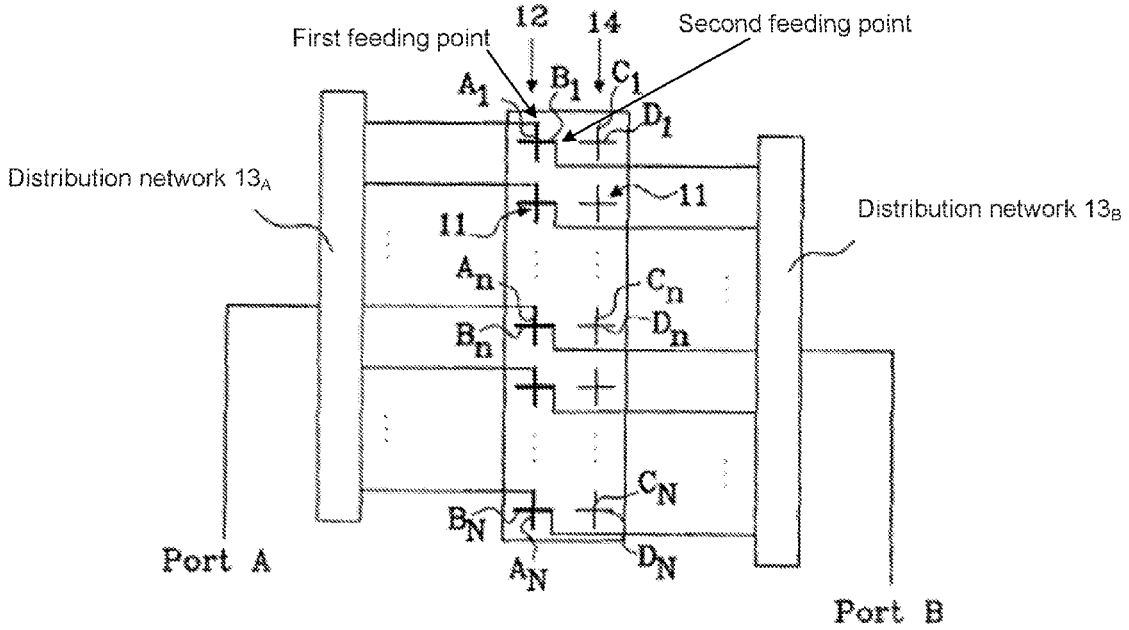
FIG. 2 shows examples of distribution networks of the antenna configuration in FIG. 1 that may be used for elevation beam forming.
Figure 3:
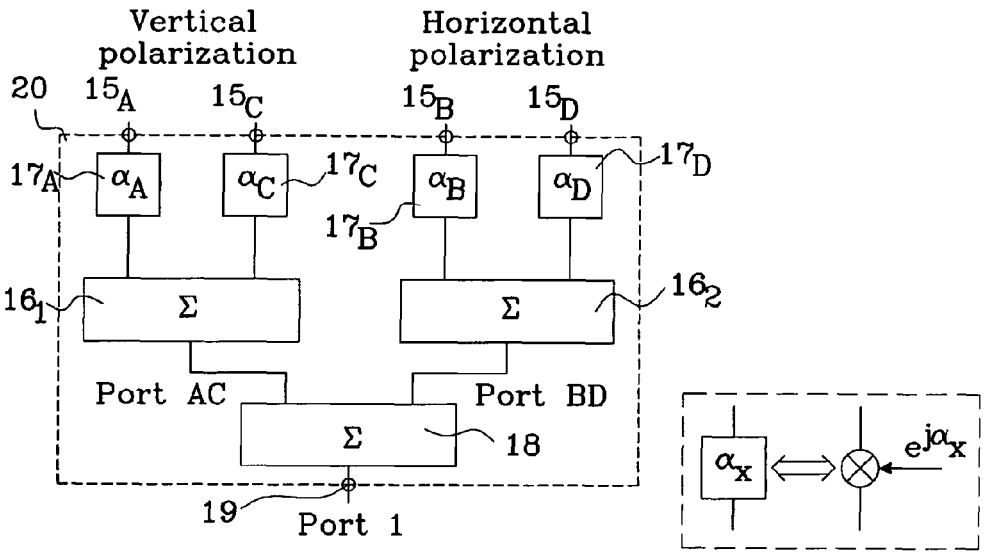
FIG. 3 shows a beam forming network according to the invention intended to be connected to distribution networks as illustrated in FIGS. 1 and 2 to obtain a first single beam antenna according to the present invention.

FIG. 2 shows examples of distribution networks for Port A and port B, and FIG. 3 shows a beam-forming network for beam width and beam pointing adjustment consisting of phase shifters and power combiners/splitters.

FIGS. 1-3 together illustrate a first embodiment of an antenna according to the invention, which in this example is a single beam antenna. The single beam antenna comprises an antenna configuration 10 having two columns of N groups of dual polarized array elements 11, with a column separation $D_H$ and a row separation $D_V$. In this embodiment each group "n" comprises two vertically polarized radiating elements $A_n$ and $C_n$, and two horizontally polarized radiating elements $B_n$ and $D_n$ (n=1 to N), where N is at least one (N≥1), preferably more than two (N>2). Each array element 11 has two feeding points (not shown), a first feeding point associated with vertical polarization, i.e. connected to the radiating element $A_n$ in a first column 12 and radiating element $C_n$ in a second column 14, respectively, and a second feeding point associated with horizontal polarization, i.e. connected to the radiating element $B_n$ in a first column 12 and radiating element $D_n$ in a second column 14, respectively, see FIG. 1.

The first feeding points connected to radiating elements $A_n$ in the left column 12 are connected via a first distribution network $\mathbf{13}_A$, preferably implemented as an elevation beam-forming network, to a port A, and the second feeding points connected to radiating elements $B_n$ in the left column 12 are connected via a second distribution network $\mathbf{13}_B$, preferably implemented as an elevation beam-forming network to a port B, see FIG. 2. Similarly, the feeding points connected to radiating elements $C_n$ and $D_n$ in the right column 14 are connected via separate distribution networks (not shown), preferably implemented as elevation beam-forming networks, to port C and port D, respectively. Thus, for each column, a distribution network exclusively connects a port to the feeding points of the array elements 11 having the same polarization, i.e. port A to radiating elements $A_1$-$A_N$, and port B to radiating elements $B_1$-$B_N$, etc.

The four ports, Port A-Port D, are combined to one antenna port, Port 1, by a beam forming network 20 as illustrated in FIG. 3. The beam forming network 20 is provided with a primary connection 19 intended to be connected to antenna port 1 and four secondary connections $\mathbf{15}_A$-$\mathbf{15}_D$. Each port A, B, C and D are connected to a secondary connection $\mathbf{15}_A$, $\mathbf{15}_B$, $\mathbf{15}_C$ and $\mathbf{15}_D$, respectively, of the beam forming network 20. The vertical polarized linear array corresponding to Port A of the first column 12 and the vertical polarized linear array corresponding to Port C of the second column 14 are connected via a first phase shifting network controlling the phase shift difference and splitting the power between the columns. The first phase shifting network comprises a first secondary power combiner/splitter $\mathbf{16}_1$, splitting the power between the columns, and variable phase shifters $\mathbf{17}_A$ and $\mathbf{17}_C$, applying phase shifts $\alpha_A$ and $\alpha_C$, respectively. The horizontal polarized linear array corresponding to Port B of the first column 12 and the horizontal polarized linear array corresponding to Port D of the second column 14 are connected via a second phase shifting network comprising a second secondary power combiner/splitter $\mathbf{16}_2$, splitting the power between the columns, and variable phase shifters $\mathbf{17}_B$ and $\mathbf{17}_D$, applying phase shifts $\alpha_B$ and $\alpha_D$. The combined ports AC and BD are then connected via a primary power combiner/splitter 18, splitting the power between radiating elements having different polarization, to the antenna Port 1.

The beam forming network 20 and the distribution networks $\mathbf{13}_A$-$\mathbf{13}_D$, as illustrated in FIG. 2, together forms a feeding network that connects antenna port 1 to the respective feeding points of the array elements 11 arranged in the two columns.

Figure 4:
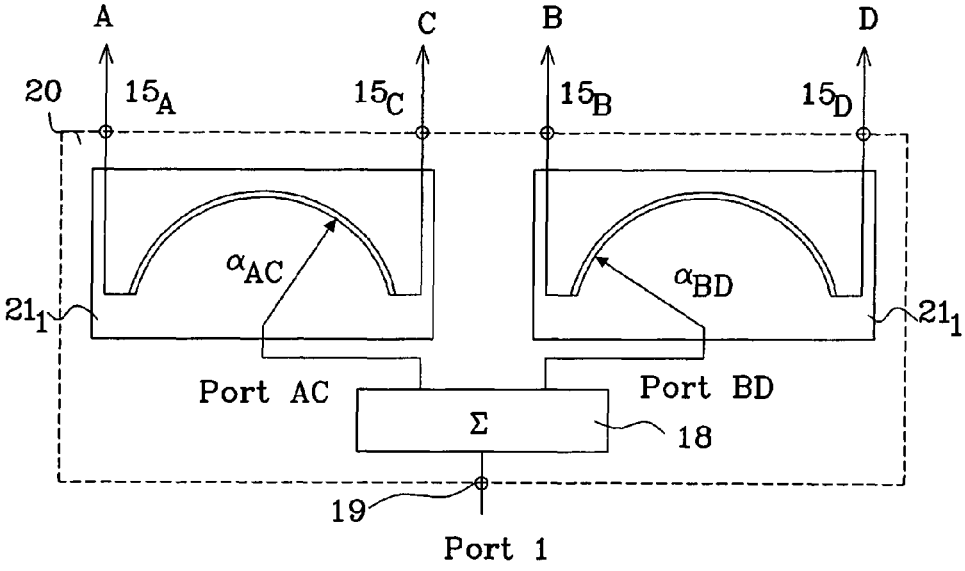
FIG. 4 shows an implementation of the beam forming network in FIG. 3.

FIG. 4 shows another example of a realization of the beam forming network 20 in FIG. 3. A phase shifting networks comprising two integrated power combiner/splitter and phase shifting devices $\mathbf{21}_1$ and $\mathbf{21}_2$ are used to feed ports A, C and ports B, D. The angles $\alpha_{XY}$ is the difference in electrical phase angle between port X and port Y. In this case there is a phase difference $\alpha_{AC}=\alpha_A-\alpha_C$ between Port A and Port C and a phase difference $\alpha_{BD}=\alpha_B-\alpha_D$ between Port B and Port D.

Feeding Port A and Port C with the same amplitude and with a phase difference $\alpha_{AC}$, gives a vertical polarized beam where the azimuth beam pointing depends on the phase difference $\alpha_{AC}$. For the dual column array in this example the relation between the spatial azimuth beam-pointing angle $\phi$ and the electrical phase difference $\alpha$ is given by $$\alpha(\phi, D_H, \lambda) = 2\pi\frac{D_H}{\lambda}\sin(\phi)$$

and vice versa $$\phi(\alpha, D_H, \lambda) = \sin^{-1}\left(\frac{\alpha}{2\pi\frac{D_H}{\lambda}}\right)$$

where $D_H$ is the column separation and $\lambda$ is the wavelength of the signal transmitted/received.

Similar, feeding Port B and Port D with the same amplitude and with a phase difference $\alpha_{BD}$, gives a horizontal polarized beam where the azimuth beam pointing depends on the phase difference $\alpha_{BD}$.

The primary power combiner/splitter 18 in FIG. 3 or FIG. 4 combines the combined ports AC with the combined ports BD to antenna Port 1. Since the combined ports AC corresponds to a vertical polarized radiation pattern and the combined ports BD corresponds to a horizontal polarized radiation pattern the resulting radiation pattern of antenna Port 1 equals the power sum of the radiation pattern of the combined ports AC and the radiation pattern of the combined ports BD. Hence the beam width and beam pointing of the radiation pattern of antenna Port 1 can be controlled by means of the variable phases $\alpha_A$, $\alpha_B$, $\alpha_C$ and $\alpha_D$ in FIG. 3 or the variable phase differences $\alpha_{AC}$ and $\alpha_{BD}$ in FIG. 4.

Note that the beam of Port 1 will have a polarization that varies with the azimuth angle if the vertical and the horizontal beams do not have the same pointing direction and shape.

For simplicity, all antennas in the illustrative examples are assumed to be vertically oriented with columns of array elements along the vertical dimension. Thus, horizontal angles are associated with angles around an axis parallel to the columns and elevation angles are associated with angles relative the vertical axis, respectively. In general, however, the antennas can have any orientation."

EXAMPLE 1

As an example, a first single beam antenna as described in connection with FIGS. 1-4, is simulated in which the number of array elements in each column is 12 (i.e. N=12) and the column separation $D_H$ between array elements, and thus the distance between first and second phase centres arranged in different columns, is selected to be half a wavelength ($D_H=0.5\lambda$), and assuming a radiating element pattern with a half power beam width of 90°.

Figure 5:
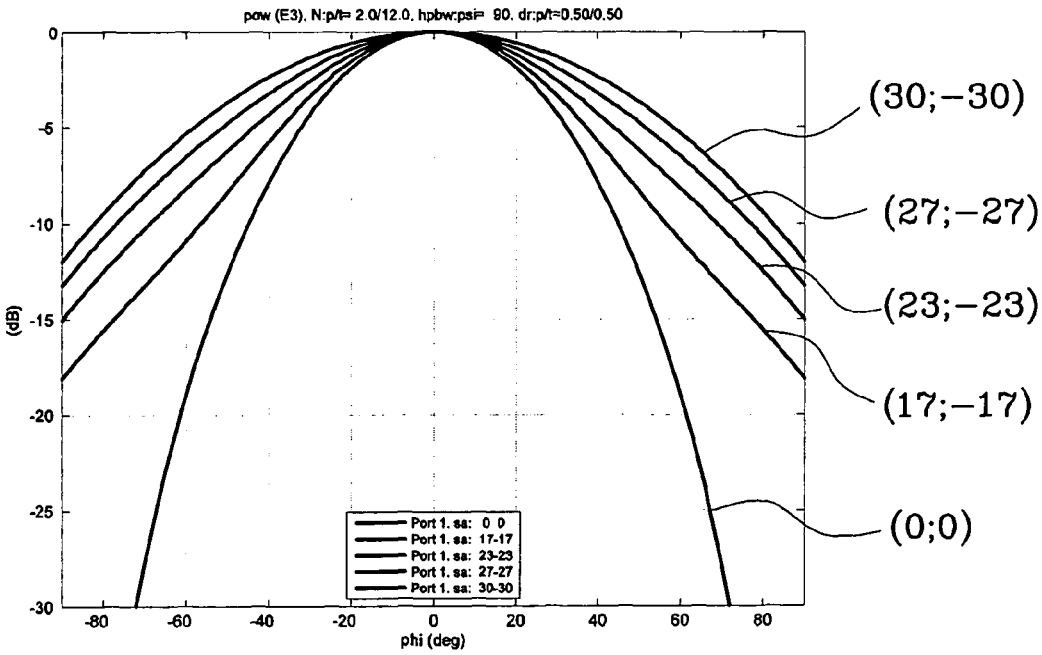
FIG. 5 shows predicted azimuth beam pattern for a first single beam antenna according to the invention having a column separation $D_H$=0.5λ with a first set of phase differences.

FIG. 5 shows predicted azimuth beam patterns for the first single beam antenna and the variable phases:

$$\alpha_{AC}=-\alpha_{BD}=\alpha$$

for different angles $\alpha$ expressed in terms of the spatial beam pointing angle $\phi(\alpha)$. Curve (0;0) denotes $\phi(\alpha_{AC})=\phi(\alpha_{BD})=0$, curve (17;−17) denotes $\phi(\alpha_{AC})=-\phi(\alpha_{BD})=17$, curve (23;−23) denotes $\phi(\alpha_{AC})=-\phi(\alpha_{BD})=23$, curve (27;−27) denotes $\phi(\alpha_{AC})=-\phi(\alpha_{BD})=27$, and curve (30;−30) denotes $\phi(\alpha_{AC})=-\phi(\alpha_{BD})=30$. For the azimuth beam patterns the half power beam width is 50, 56, 65, 77 and 90 degrees, respectively.

Figure 6:
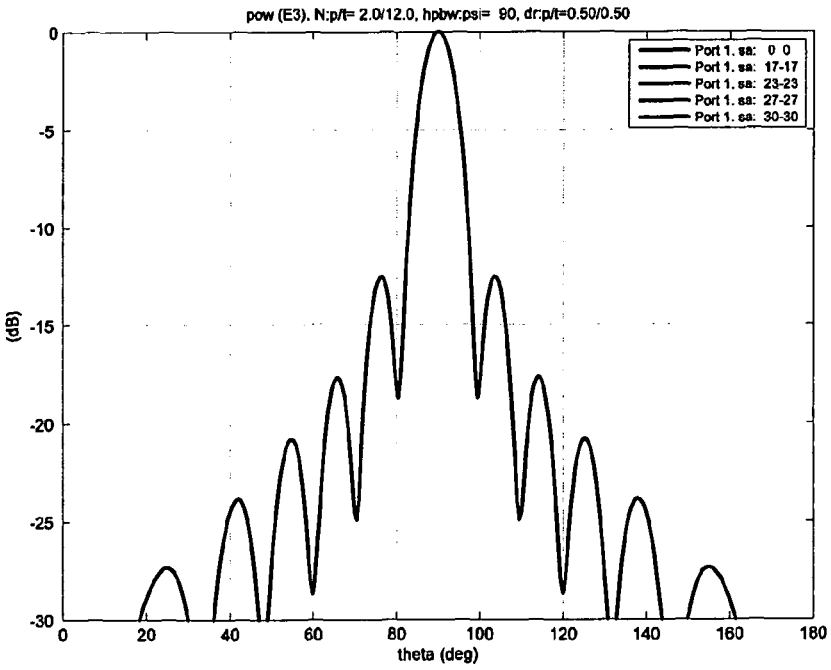
FIG. 6 shows a predicted elevation beam pattern for the first single beam antenna according to the invention having a column separation $D_H$=0.5λ with the first set of phase differences.

FIG. 6 shows the corresponding elevation patterns for the first single beam antenna. The five patterns are on top of each other.

Figure 7:
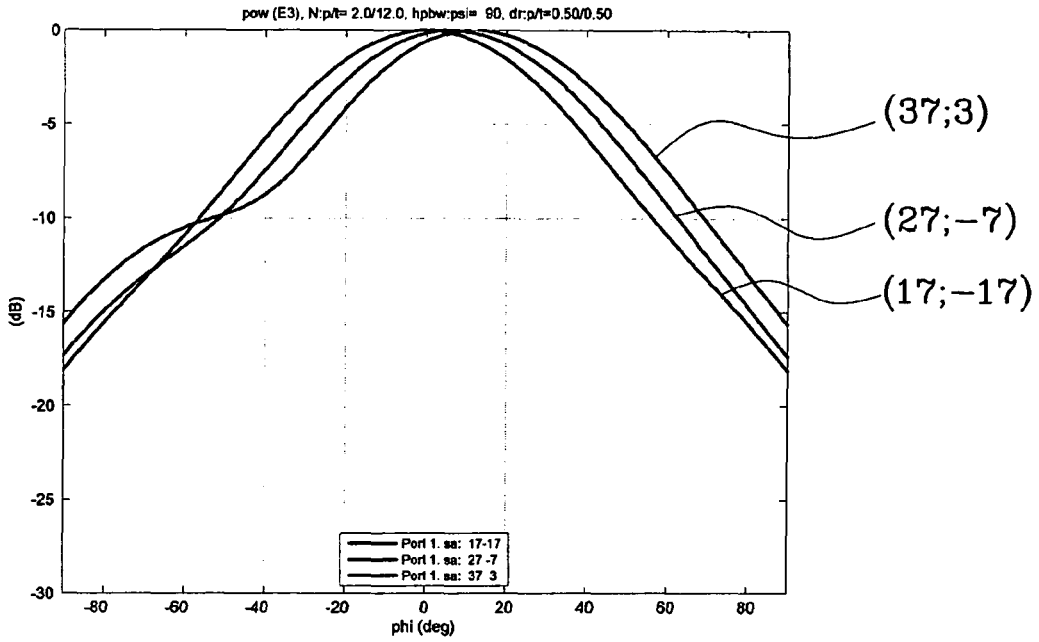
FIG. 7 shows predicted azimuth beam pattern for the first single beam antenna according to the invention having a column separation $D_H$=0.7λ with a second set of phase differences.

FIG. 7 shows predicted azimuth beam patterns for the same configuration as the first single beam antenna, but with the phase differences $\alpha_{AC}$ and $\alpha_{BD}$ set according to $$\phi(\alpha_{AC})-17°=\phi(\alpha_{BD})+17°=\delta$$

where δ=[0°, 10° and 20°]. Curve (17;−17) denotes δ=0°, i.e. $\phi(\alpha_{AC})=17°$ and $\phi(\alpha_{BD})=-17°$, similarly curve (27;−7) denotes δ=10° and curve (37;3) denotes δ=20°. Thus, the spatial beam pointing angles are +/−17° plus beam offsets of 0°, 10° and 20°, respectively. For the azimuth beam patterns the half power band width is 56 degrees for all offsets.

Figure 8:
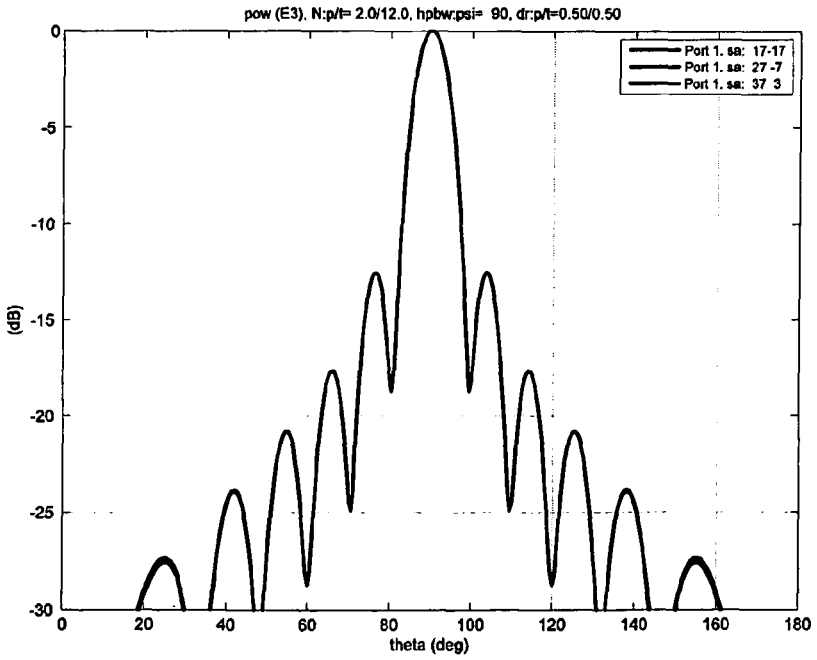
FIG. 8 shows predicted elevation beam pattern for the first single beam antenna according to the invention having a column separation $D_H$=0.7λ with the second set of phase differences.

FIG. 8 shows the corresponding elevation patterns for the first single beam antenna with δ=[0°, 10° and 20°]. The three patterns are on top of each other.

EXAMPLE 2

As a further example, a second single beam antenna as described in connection with FIGS. 1-4, in which the number of array elements in each column is 12 (i.e. N=12) and the column separation $D_H$ between array elements, and thus the distance between first and second phase centres arranged in different columns, is selected to be seven tenths of a wavelength ($D_H$=0.7λ), and assuming a radiating element pattern with a half power beam width of 65°.

Figure 9:
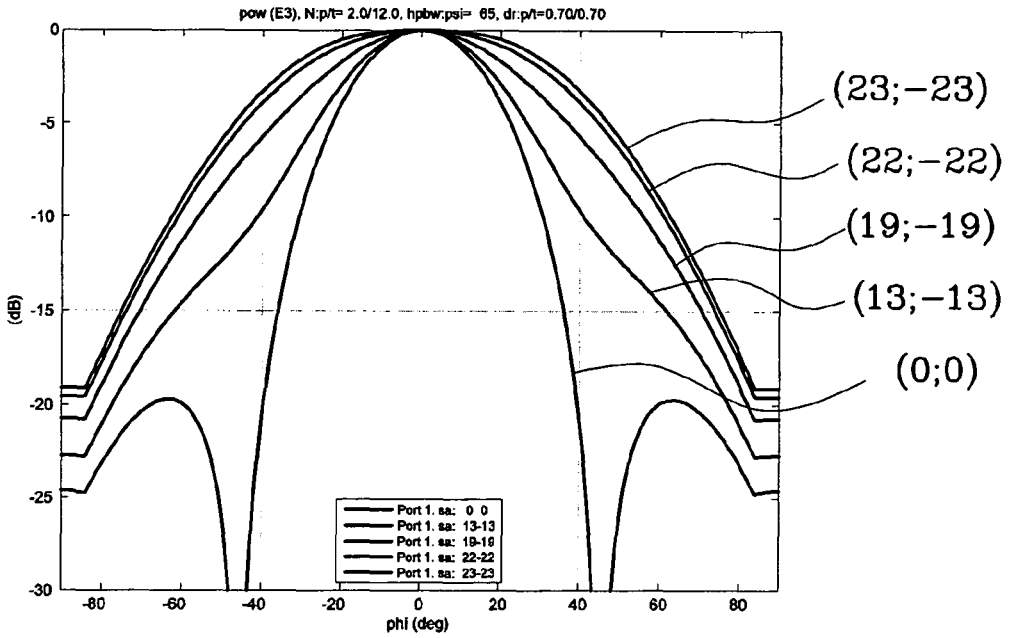
FIG. 9 shows predicted azimuth antenna pattern for a second single beam antenna according to the invention having a column separation $D_H$=0.7λ with a third set of phase differences.

FIG. 9 shows predicted azimuth beam patterns for the second single beam antenna and the variable phases:

$$\alpha_{AC}=-\alpha_{BD}=\alpha$$

for different angles α expressed in terms of the spatial beam pointing angle φ(α). Curve (0;0) denotes $\phi(\alpha_{AC})=\phi(\alpha_{BD})=0$, curve (13;−13) denotes $\phi(\alpha_{AC})=-\phi(\alpha_{BD})=13$, curve (19;−19) denotes $\phi(\alpha_{AC})=-\phi(\alpha_{BD})=19$, curve (22;−22) denotes $\phi(\alpha_{AC})=-\phi(\alpha_{BD})=22$, and curve (23;−23) denotes $\phi(\alpha_{AC})=-\phi(\alpha_{BD})=23$. For the azimuth beam patterns the half power band width is 35, 41, 55, 71, and 83 degrees, respectively.

Figure 10:
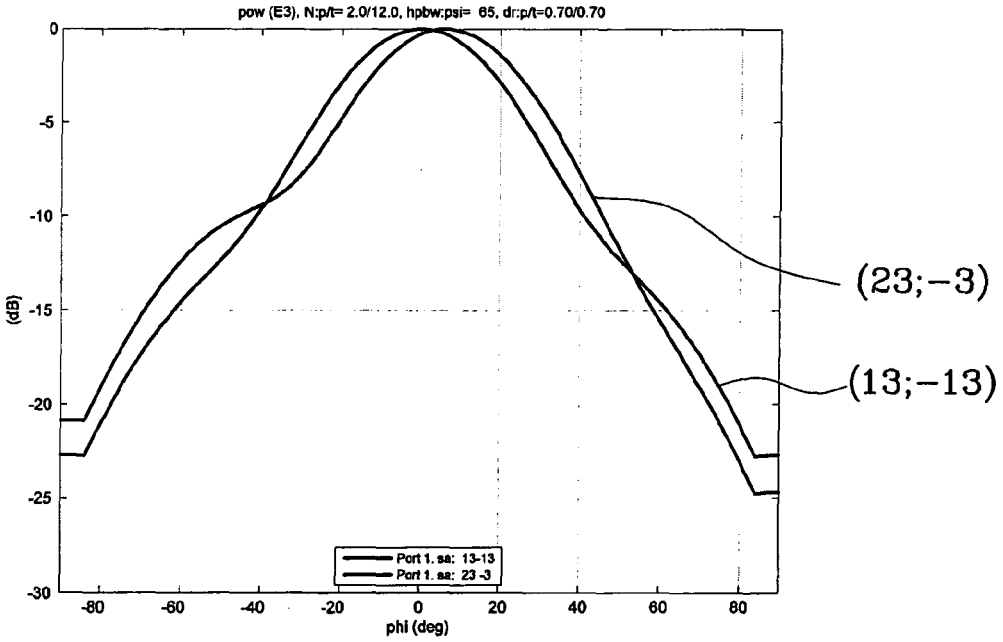
FIG. 10 shows predicted azimuth antenna pattern for the second single beam antenna according to the invention having a column separation $D_H$=0.7λ with a fourth set of phase differences.

FIG. 10 shows predicted azimuth beam patterns for the second single beam antenna, but with the phase differences $\alpha_{AC}$ and $\alpha_{BD}$ set according to $$\phi(\alpha_{AC})-13°=\phi(\alpha_{BD})+13°=\delta$$

where δ=[0° and 10°]. Curve (13;−13) denotes δ=0°, i.e. $\phi(\alpha_{AC})=13°$ and $\phi(\alpha_{BD})=-13°$, similarly curve (23;−3) denotes δ=10°. Thus, the spatial beam pointing angles φ are +/−13° plus beam offsets of 0° and 10°, respectively. For azimuth beam patterns the half power band width is 41 degrees for both beams.

The examples above describe a single beam antenna. However, in mobile communication systems it is common to use dual-polarized antennas for the purpose of achieving a dual beam antenna, i.e. having two beams covering the same area but with orthogonal polarization.

Figure 11:
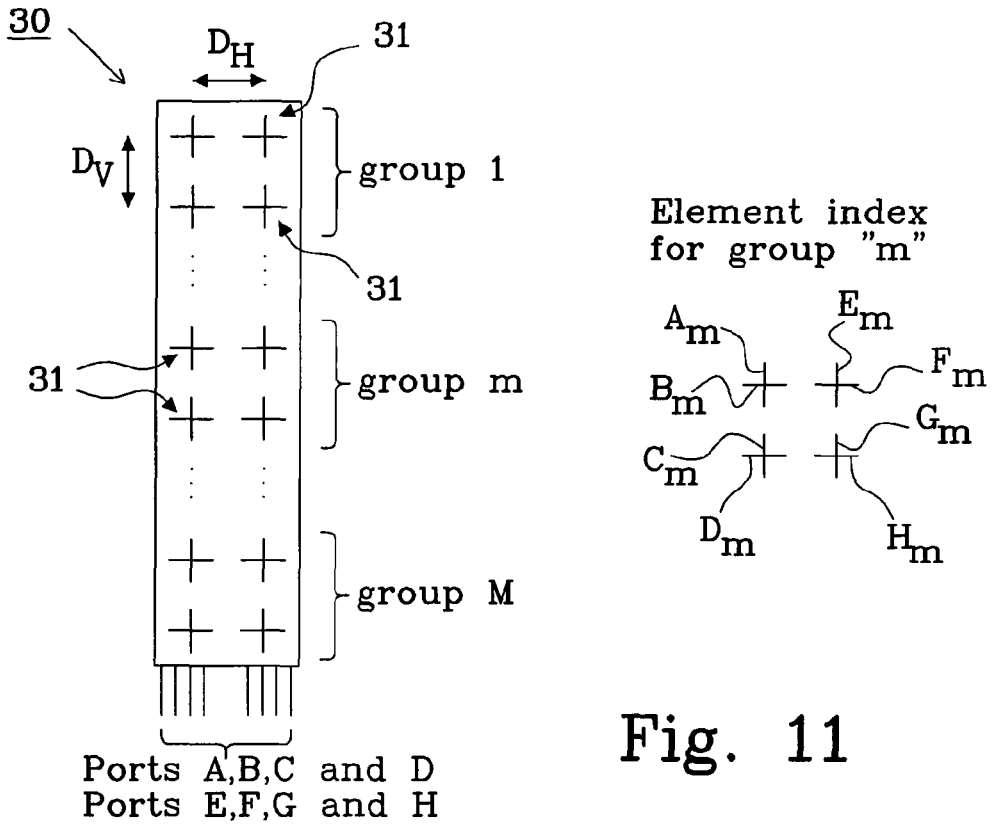
FIG. 11 shows a second antenna configuration which may be used to implement the present invention.

FIG. 11 shows an antenna configuration (to the left) according to the invention with M groups, each with four dual polarized array elements, each having a first feeding point and a second feeding point associated with orthogonal polarizations and having a first and second phase centre arranged in two columns as described in connection with FIG. 1. To the right is shown indexing of the elements within a group "m". The elements are arranged to form eight linear arrays, each connected to a port A-H.

Figure 12:
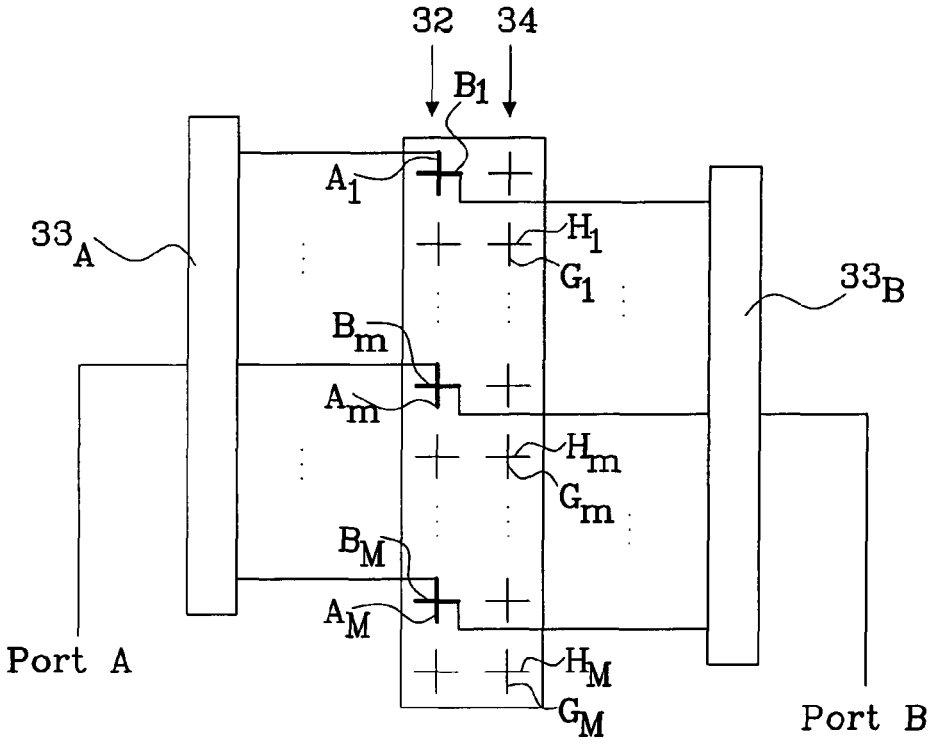
FIG. 12 shows examples of distribution networks of the antenna configuration in FIG. 11 that may be used for elevation beam forming.
Figure 13:
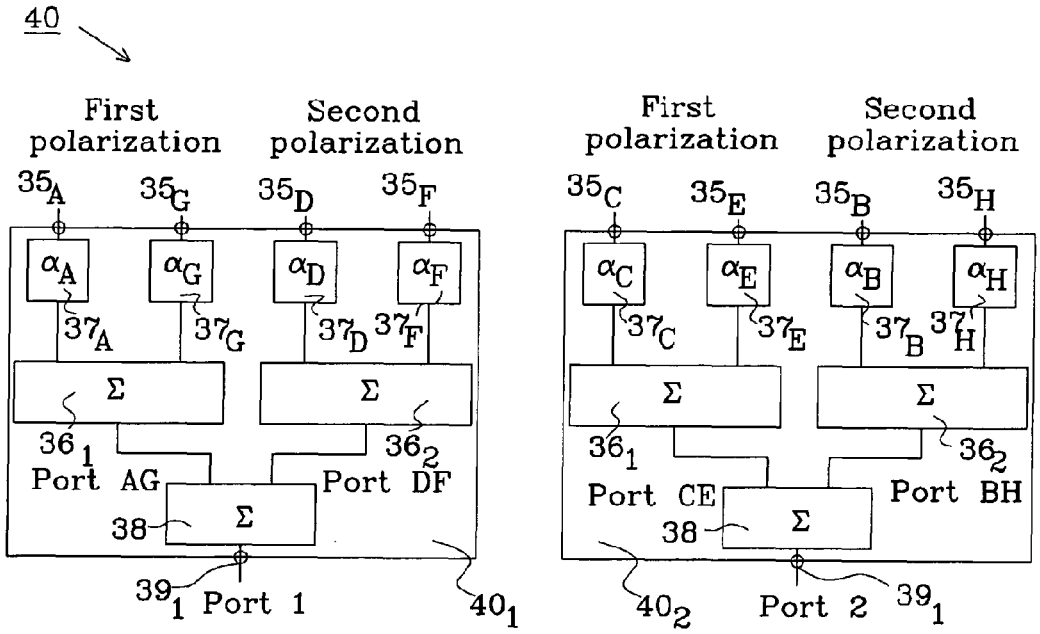
FIG. 13 shows a first embodiment of a dual beam forming network according to the invention intended to be connected to distribution networks as illustrated in FIGS. 11 and 12 to obtain a first dual beam antenna according to the present invention.

FIG. 12 shows examples of distribution networks for Port A and port B, and FIG. 13 shows a beam-forming network for beam width and beam pointing adjustment consisting of phase shifters and power combiners/splitters.

FIGS. 11-13 together illustrate a second embodiment of an antenna according to the invention, which in this example is a dual beam antenna with orthogonal polarization where each beam has variable beam width and beam pointing. The dual beam antenna comprises an antenna configuration 30 having two columns of dual polarized array elements 31, with a column separation $D_H$ and a row separation $D_V$. In this embodiment each group "m" comprises four vertically polarized radiating elements $A_m$, $C_m$, $E_m$ and $G_m$, and four horizontally polarized radiating elements $B_m$, $D_m$, $F_m$ and $H_m$ (m=1 to M), where M is at least one (M≥1), preferably more than two (M>2). Each array element 31 has two feeding points (not shown), a first feeding point for vertical polarization and a second feeding point for horizontal polarization. The first feeding point is connected to the radiating elements $A_m$ and the radiating elements $C_m$ in a first column 32, and radiating elements $E_m$ and the radiating elements $G_m$ in a second column 34. The second feeding point is connected to the radiating elements $B_m$ and the radiating elements $D_m$ in a first column 32, and radiating elements $F_m$ and radiating elements $H_m$ in a second column 34, see FIG. 11.

Each feeding point of every second radiating element in each column is connected via a distribution network, preferably implemented as an elevation beam-forming network, resulting in four ports per column A-D and E-H, respectively, see FIG. 11. FIG. 12 gives an example of distribution networks $\mathbf{33}_A$, $\mathbf{33}_B$ preferably implemented as elevation beam-forming networks. The feeding points connected to the radiating elements $A_1$-$A_M$ are connected via a distribution network $\mathbf{33}_A$ to a port A forming an M-element vertical linear array with vertical polarization. The feeding points connected to the radiating elements $B_1$-$B_M$ are connected via a second distribution network $\mathbf{33}_B$ to a port B forming an M-element vertical linear array with horizontal polarization. Similarly, the feeding points connected to the radiating elements $C_1$-$C_M$ through $H_1$-$H_M$ are connected via individual distribution networks $\mathbf{33}_C$-$\mathbf{33}_H$ to ports C-H. Hence each column consists of two interleaved M-elements linear arrays of dual polarized array elements giving in total eight ports A-H, see FIGS. 11 and 12.

The eight ports, Port A-Port H, are now combined to two antenna ports, Port 1 and Port 2, by a first embodiment of a dual beam forming network 40 (comprising two separate beam forming networks $\mathbf{40}_1$ and $\mathbf{40}_2$) as illustrated in FIG. 13. Each separate beam forming network $\mathbf{40}_1$, $\mathbf{40}_2$ is provided with a primary connection $\mathbf{39}_1$, $\mathbf{39}_2$ intended to be connected to antenna port 1 and port 2, respectively. Each port A-H is connected to a respective secondary connection $\mathbf{35}_A$-$\mathbf{35}_H$ of the dual beam forming network 40. The vertical polarized linear array corresponding to Port A of the first column 32 and the vertical polarized linear array corresponding to Port G of the second column 34 are connected via a first phase shifting network comprising a first secondary power combiner/splitter $\mathbf{36}_1$ and variable phase shifters $\mathbf{37}_A$ and $\mathbf{37}_G$, applying phase shifts $\alpha_A$ and $\alpha_G$, respectively. The horizontal polarized linear array corresponding to Port D of the first column 32 and the horizontal polarized linear array corresponding to Port F of the second column 34 are connected via a second phase shifting network comprising a second secondary power combiner/splitter $\mathbf{36}_2$ and variable phase shifters $\mathbf{37}_D$ and $\mathbf{37}_F$, applying the phase shifts $\alpha_D$ and $\alpha_F$, respectively. The combined ports AG and DF are then combined by a primary power combiner/splitter 38 via the primary connection $\mathbf{39}_1$ to the antenna Port 1. Similarly the antenna Port 2 is created by combining the ports C, E, B and H using the beam forming network $40_2$ as illustrated in FIG. 13. By this arrangement the beam-width and/or the pointing direction of the antenna power patterns of antenna Port 1 and Port 2 may be changed by properly selecting phase angles $\alpha_A$, $\alpha_B$, $\alpha_C$, $\alpha_D$, $\alpha_E$, $\alpha_F$, $\alpha_G$ and $\alpha_H$.

Note that the beams of antenna port 1 and antenna port 2 will have orthogonal polarization for all azimuth angles if the phase difference between the horizontal and vertical polarized radiating elements of antenna port 1 is properly chosen relative to the phase difference between the horizontal and vertical polarized radiating elements of antenna port 2, as illustrated below.

EXAMPLE 3

As an example, a first dual beam antenna as described in connection with FIGS. 11-13, in which the number of array elements in each column is 12 (i.e. M=6) and the column separation $D_H$ between array elements, and thus the distance between first and second phase centres arranged in different columns, is selected to be half of a wavelength ($D_H$=0.5λ), and assuming a radiating element pattern with a half power beam width of 90°.

Figure 14:
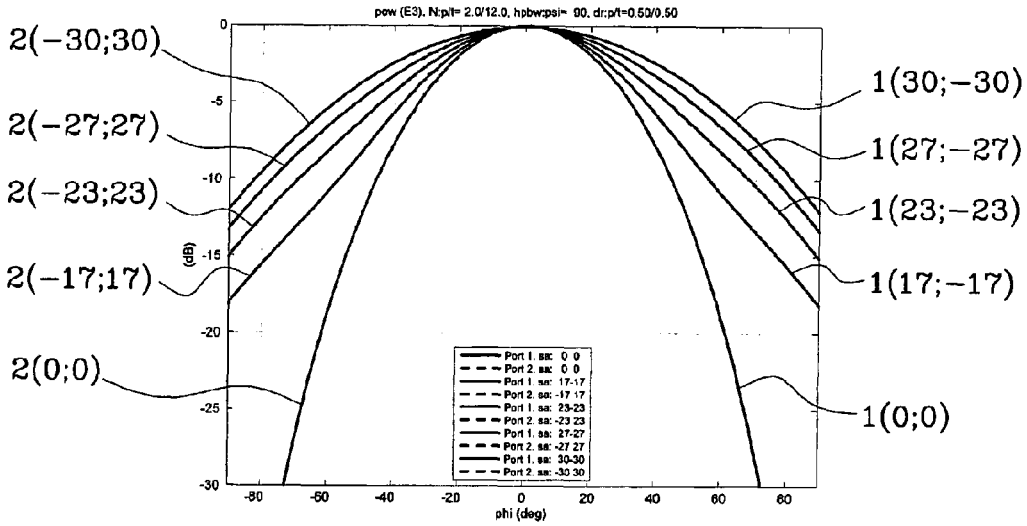
FIG. 14 shows predicted azimuth beam pattern for the first dual beam antenna according to the invention having a column separation $D_H$=0.5λ with the first set of phase differences.

FIG. 14 shows predicted azimuth beam patterns for the first dual beam antenna and variable phases:

$$\alpha_A-\alpha_G=\alpha_F-\alpha_D=\alpha_B-\alpha_H=\alpha_E-\alpha_C=\alpha$$

for different angles α expressed in terms of the spatial beam pointing angle φ(α). Curve 1 (0;0) and curve 2 (0;0), which denotes φ=0 for each antenna port, overlap and similarly curve 1 (17;−17) and curve 2 (−17;17), curve 1 (23,−23) and curve 2 (−23;23), curve 1 (27;−27) and curve 2 (−27;27), and curve 1 (30;−30) and curve 2 (−30;30) are pair-wise identical, i.e., the radiation patterns associated with antenna ports 1 and 2 overlap. For the azimuth beam patterns the half power band width is 50, 56, 65, 77 and 90 degrees, respectively.

The relation between spatial angle φ and phase difference α is given by $$\alpha(\phi, D_H, \lambda) = 2\pi\frac{D_H}{\lambda}\sin(\phi)$$

and vice versa $$\phi(\alpha, D_H, \lambda) = \sin^{-1}\left(\frac{\alpha}{2\pi\frac{D_H}{\lambda}}\right)$$

Figure 15:
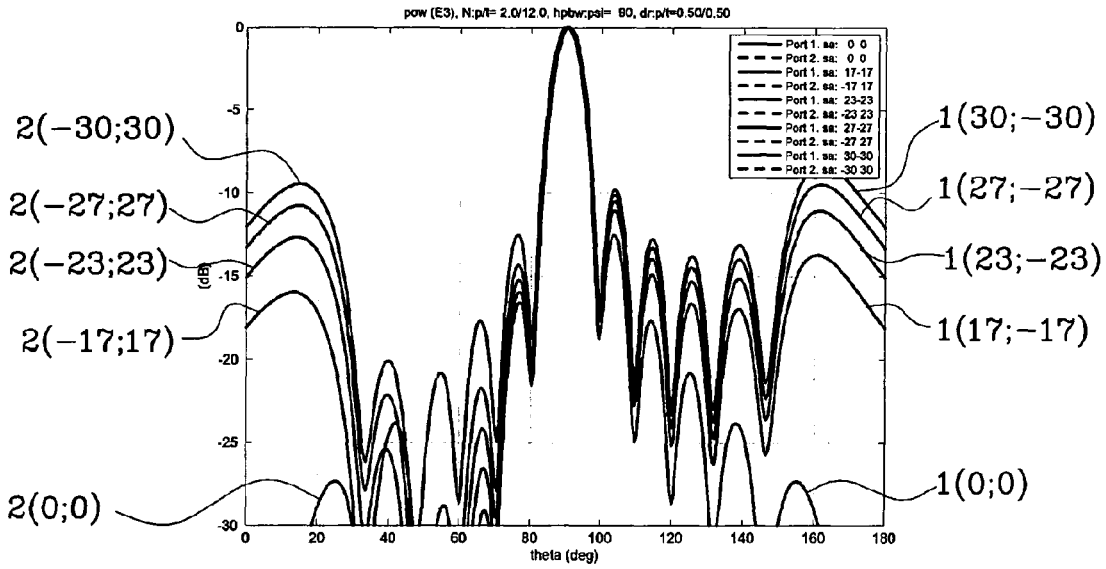
FIG. 15 shows a predicted elevation beam pattern for the first dual beam antenna according to the invention having a column separation $D_H$=0.5λ with the first set of phase differences.

FIG. 15 shows the corresponding elevation patterns for the first dual beam antenna.

Figure 16:
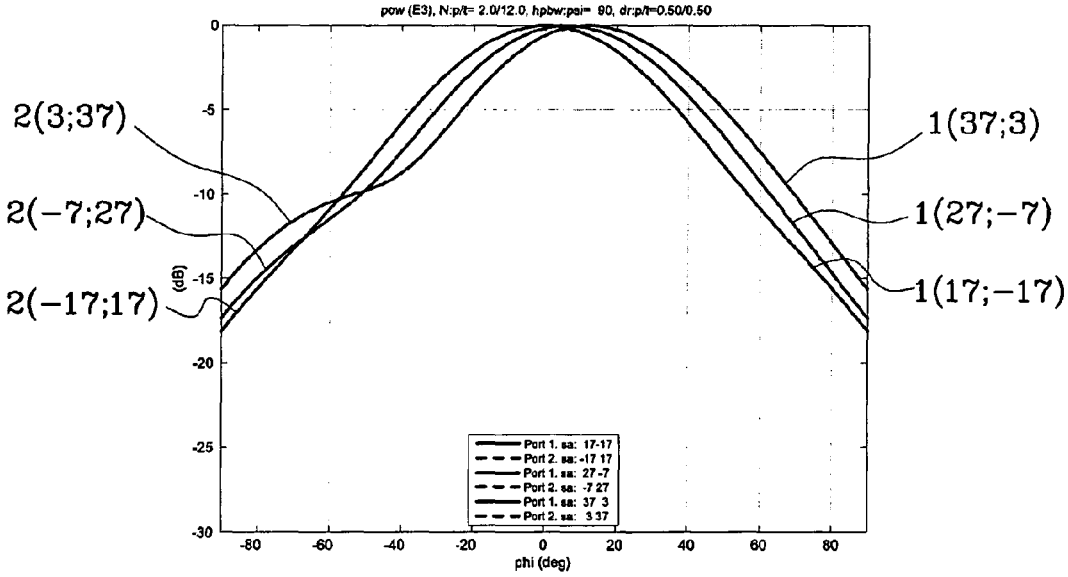
FIG. 16 shows predicted azimuth antenna pattern for the first dual beam antenna according to the invention having a column separation $D_H$=0.5λ with the second set of phase differences.

FIG. 16 shows predicted azimuth beam patterns for the same configuration as the first dual beam antenna, but with the phase differences $\alpha_A-\alpha_G$, $\alpha_D-\alpha_F$, $\alpha_B-\alpha_H$ and $\alpha_C-\alpha_E$ set according to $$\phi(\alpha_A-\alpha_G)-17°=\phi(\alpha_D-\alpha_F)+17°=\phi(\alpha_C-\alpha_E)+17°=\phi(\alpha_B-\alpha_H)-17°=\delta$$

where δ=[0°, 10° and 20°]. Curve 1 (17;−17) is equal to 2 (−17;17) which denote δ=0°, i.e. $\phi(\alpha_A-\alpha_G)=\phi(\alpha_B-\alpha_H)=17°$ and $\phi(\alpha_D-\alpha_F)=\phi(\alpha_C-\alpha_E)=-17°$, similarly curve 1 (27;−7) is equal to 2 (−7;27) which denote δ=10° and curve 1 (37;3) is equal to 2 (3;37) which denote δ=20°. The spatial beam pointing angles φ (relating to port AG, BH, CE and BH) are +/−17° plus antenna beam offsets of 0°, 10° and 20°, respectively. For the azimuth beam patterns the half power band width is 56 degrees for all settings.

Figure 17:
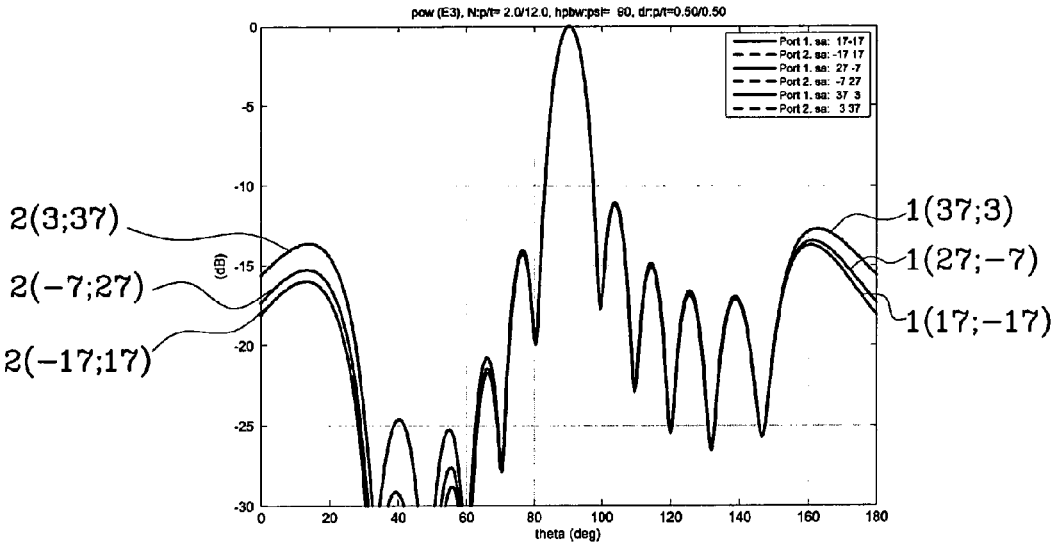
FIG. 17 shows predicted elevation beam pattern for the first dual beam antenna according to the invention having a column separation $D_H$=0.5λ with the second set phase differences.

FIG. 17 shows the corresponding elevation patterns.

Figure 18:
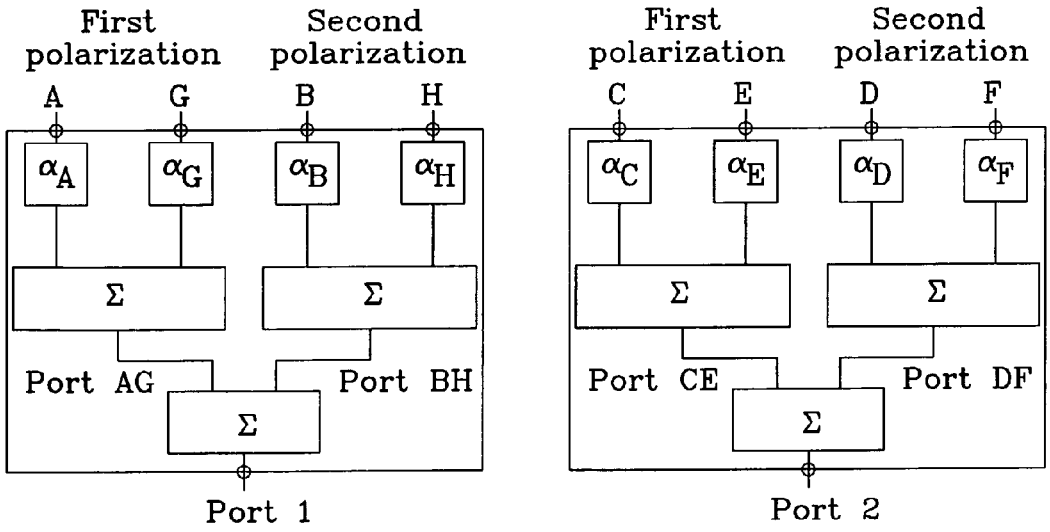
FIG. 18 shows a second embodiment of a dual beam forming network according to the invention intended to be connected to distribution networks as illustrated in FIGS. 11 and 12 to obtain a second dual beam antenna according to the present invention.

FIG. 18 shows a second embodiment of a dual beam forming network according to the invention intended to be connected to distribution networks as illustrated in FIGS. 11 and 12 to obtain a second dual beam antenna according to the present invention, where port AG is combined with port BH to form antenna port 1, and similarly port CE is combined with port DF to form antenna port 2.

Similar azimuth beam patterns as disclosed in FIGS. 14-17 will be achieved when using the configuration in FIG. 18 instead of the configuration described in FIG. 13.

Figure 19:
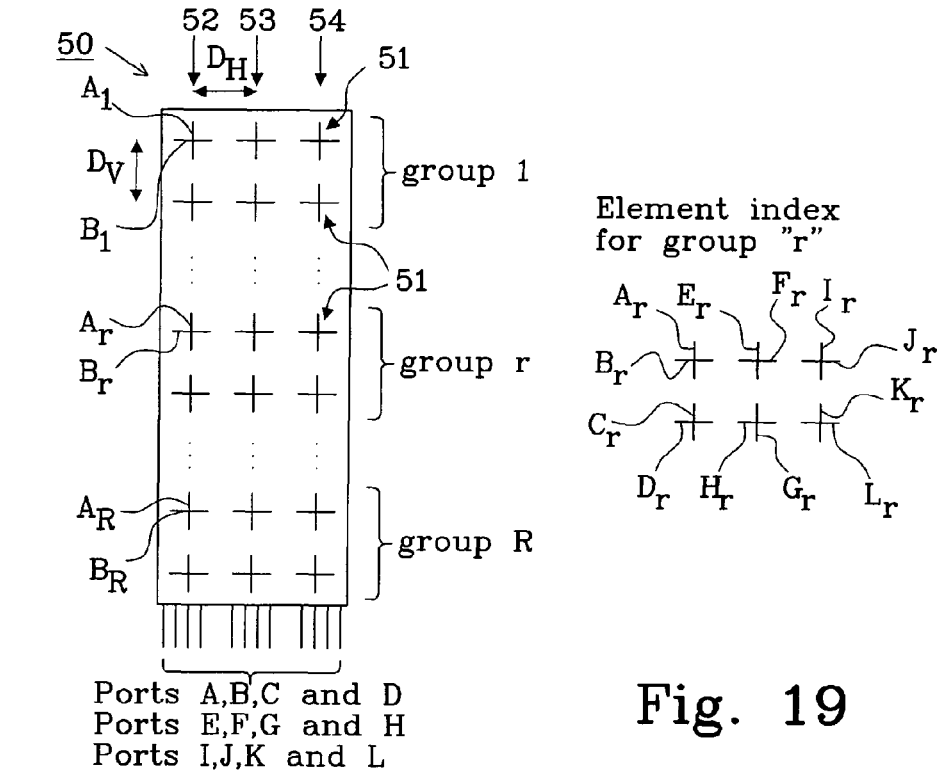
FIG. 19 shows a third antenna configuration which may be used to implement the present invention.

FIG. 19 shows an antenna configuration (to the left) according to the invention with R groups, each with six dual polarized array elements. To the right is shown indexing of the elements within a group "r". The elements are arranged to form twelve linear arrays, each connected to a port A-L.

Figure 20:
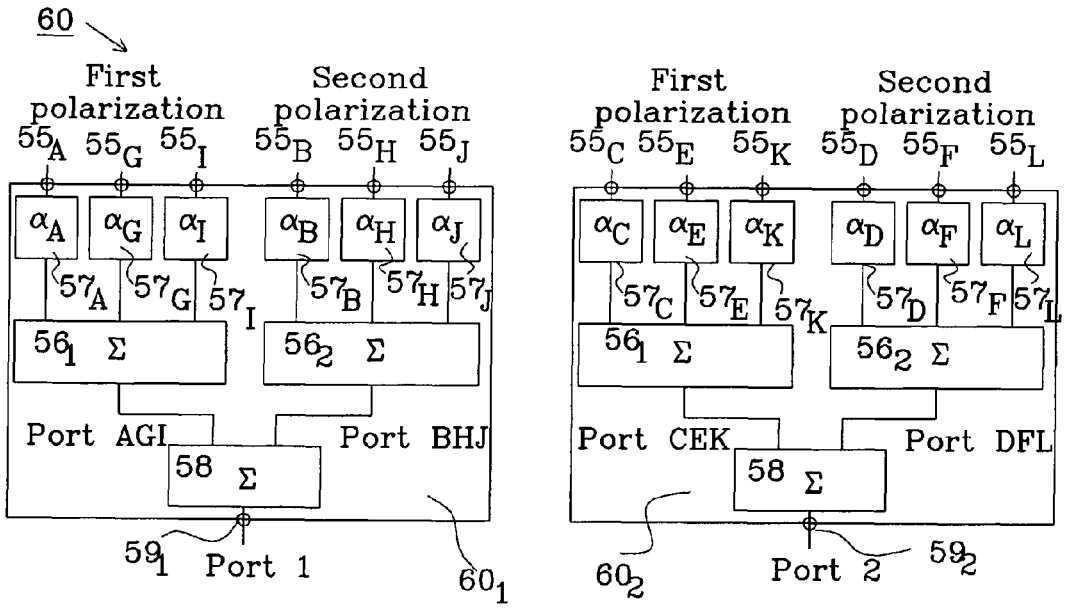
FIG. 20 shows a third embodiment of a dual beam forming network according to the invention intended to be connected to distribution networks as illustrated in FIG. 19 to obtain a second dual beam antenna according to the present invention.

FIG. 20 illustrates a beam-forming network for beam width and beam pointing adjustment according to the invention consisting of phase shifters and power combiners/splitters.

FIG. 19 and FIG. 20 together illustrate a third embodiment of an antenna according to the invention, which in this example is a dual beam antenna with orthogonal polarization where each beam has variable beam width and beam pointing. The dual beam antenna comprises an antenna configuration 50 having three columns 52-54 of R groups of dual polarized array elements 51, with a column separation $D_H$ and a row separation $D_V$. In this embodiment each group "r" comprises six vertically polarized radiating elements $A_r$, $C_r$, $E_r$, $G_r$, $I_r$ and $K_r$, and six horizontally polarized radiating elements $B_r$, $D_r$, $F_r$, $H_r$, $J_r$ and $L_r$ (r=1 to R), where R is at least one (R≥1), but preferably more than 2 (R>2). Each array element has two feeding points, a first feeding point for vertical polarization and a second feeding point for horizontal polarization, see FIG. 19. The difference to the second embodiment of the antenna described in connection with FIGS. 11-13 is that the antenna in this example comprises of dual polarized array elements in three columns instead of two, but the principals for achieving variable beam width and beam pointing is the same.

Each feeding point of every second radiating element in each column is connected via a distribution network, preferably implemented as an elevation beam forming network, resulting in four ports per column A-D, E-H and I-L, respectively, see FIG. 19. Thus the antenna element ports $A_1$-$A_R$ are connected via a first distribution network (not shown) to a port A forming an R element vertical linear array with vertical polarization. The antenna element ports $B_1$-$B_R$ are connected via a second distribution network (not shown) to a port B forming an R element vertical linear array with horizontal polarization. Similarly, the antenna elements $C_1$-$C_R$ through $L_1$-$L_R$ are connected via individual elevation beam-forming networks forming ports C-L. Hence each column consists of two interleaved R elements linear arrays of dual polarized elements giving in total twelve ports A-L, see FIG. 19.

The twelve ports, Port A-Port L, are combined to two antenna ports Port 1 and Port 2 by a third embodiment of an beam forming network 60 (comprising two separate beam forming networks $60_1$ and $60_2$) as illustrated in FIG. 20. Each separate beam forming network $60_1$, $60_2$ is provided with a primary connection $59_1$, $59_2$ intended to be connected to antenna port 1 and port 2, respectively. Each port A-L is connected to a respective secondary connection $55_A$-$55_H$ of the dual beam forming network 60. The vertical polarized linear array corresponding to Port A of the first column 52, the vertical polarized linear array corresponding to Port G of the second column 53 and the vertical polarized linear array corresponding to Port I of the third column 54 are connected via a first phase shifting network comprising a first secondary power combiner/splitter $\mathbf{56}_1$ and variable phase shifters $\mathbf{57}_A$, $\mathbf{57}_G$ and $\mathbf{57}_I$, applying phase shifts $\alpha_A$, $\alpha_G$ and $\alpha_I$, respectively. The horizontal polarized linear array corresponding to Port B of the first column 52, the horizontal polarized linear array corresponding to Port H of the second column 53 and the horizontal polarized linear array corresponding to Port J of the third column 54 are connected via a second phase shifting network comprising a second secondary power combiner/splitter $\mathbf{56}_2$ and variable phase shifters $\mathbf{57}_B$, $\mathbf{57}_H$ and $\mathbf{57}_J$, applying phase shifts $\alpha_B$, $\alpha_H$ and $\alpha_J$, respectively.

The combined ports AGI and BHJ are then combined by a primary power combiner/splitter 58 via the primary connection $\mathbf{59}_1$ to the antenna Port 1. Similarly the antenna Port 2 is created by combining the ports C, E K, D, F and L using the beam forming network $\mathbf{60}_2$ as illustrated in FIG. 20. Similar to the examples above, this arrangement allows for changing the beam-width and/or the pointing direction of the antenna power patterns of antenna Port 1 and Port 2 by properly selecting phase angles $\alpha_A$ through $\alpha_L$, as illustrated below.

EXAMPLE 4

As an example, a second dual beam antenna as described in connection with FIGS. 19-20, in which the number of array elements in each column is 12 (i.e. R=6) and the column separation $D_H$ between array elements, and thus the distance between first and second phase centres arranged in different columns, is selected to be half of a wavelength ($D_H$=0.5λ), and assuming a radiating element pattern with a half power beam width of 90°.

Figure 21:
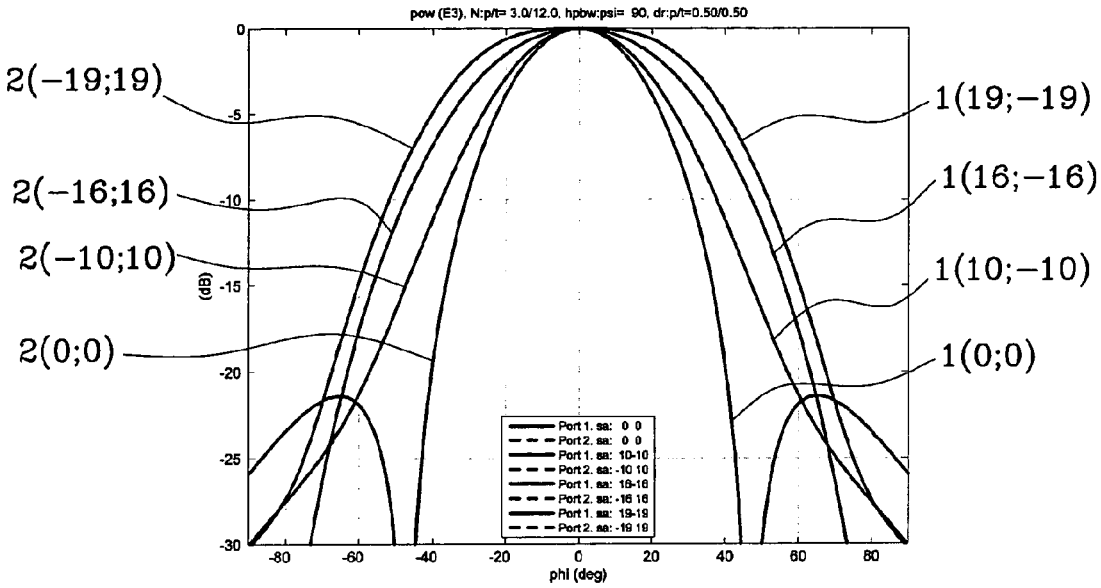
FIG. 21 shows predicted azimuth beam pattern for the second dual beam antenna according to the invention having a column separation $D_H$=0.5λ with a fifth set of phase differences.

FIG. 21 shows predicted azimuth beam patterns for the second dual beam antenna and variable phases:

A linear slope is applied, i.e. the same phase differences between two adjacent array elements since they have the same spatial separation. Curve 1 (0;0) and curve 2 (0;0), which denotes $\phi$=0 for each antenna port, overlap and similarly curve 1 (10;−10) and curve 2 (−10;10), curve 1 (16,−16) and curve 2 (−16;16), and curve 1 (19;−19) and curve 2 (−19;19) are pair-wise identical, i.e., the radiation patterns associated with antenna ports 1 and 2 overlap. For the azimuth beam patterns the half power band width is 35, 41, 55 and 67 degrees, respectively.

Figure 22:
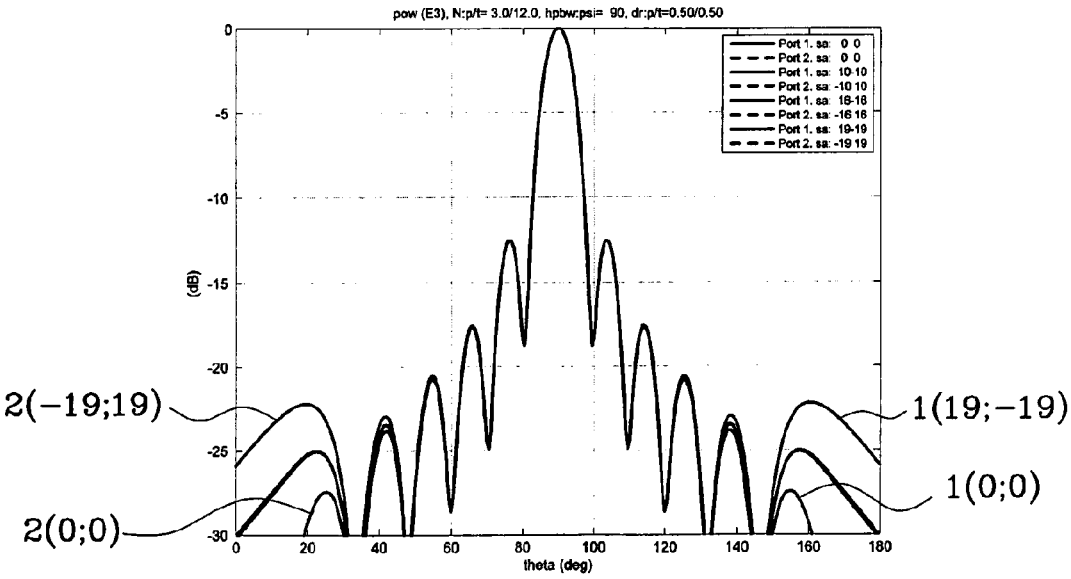
FIG. 22 shows a predicted elevation beam pattern for the second dual beam antenna according to the invention having a column separation $D_H$=0.5λ with the fifth set of phase differences.

FIG. 22 shows the corresponding elevation patterns for the second dual beam antenna.

It should be noted that although the array elements described in connection with FIGS. 1, 11 and 19 have been illustrated as array elements with a dual polarized radiating element, the invention should not be limited to this. As obvious for a skilled person from the present description, it is possible to create similar behavior using array elements with single polarized radiating elements provided the array elements are superimposed.

Figure 23:
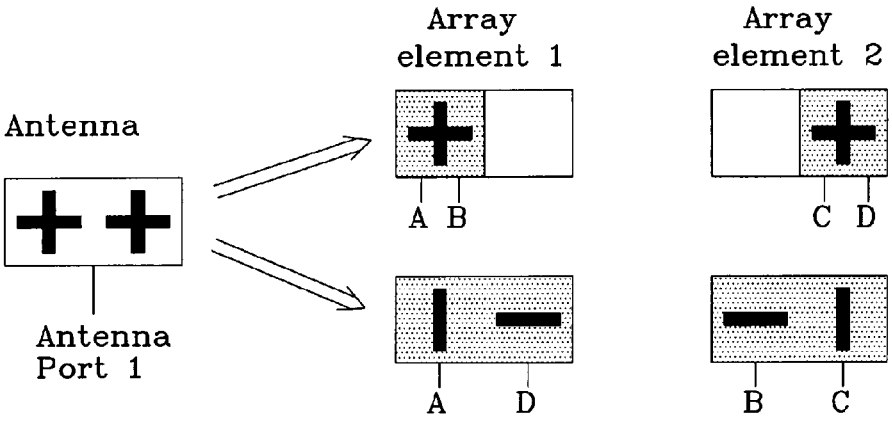
FIG. 23 shows different implementations of array elements in a single beam antenna according to the invention.
Figure 24:
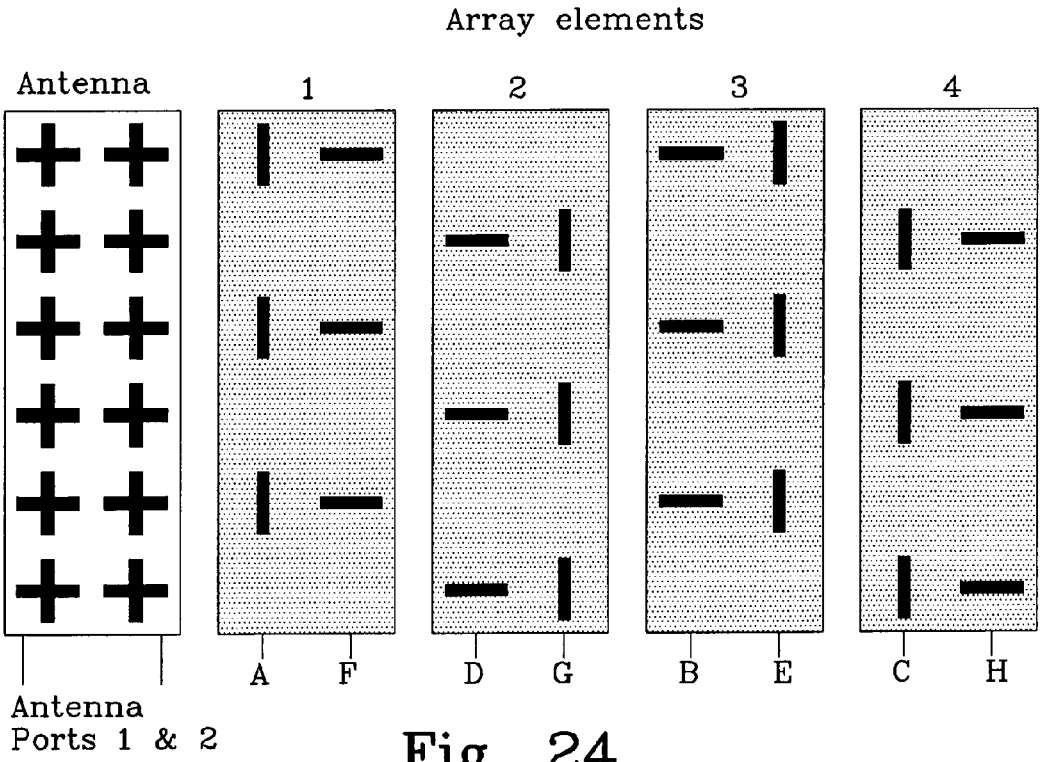
FIG. 24 shows an exemplary implementation of array elements in a dual beam antenna according to the invention.

FIGS. 23 and 24 illustrate how an antenna may be divided into two array elements (for a single beam antenna), or into four array elements (for a dual beam antenna). An array element has a first feeding point associated with a first polarization and a second feeding point associated with a second polarization, orthogonal to the first polarization. The shaded areas indicate the antenna surface needed to implement each array element.

In FIG. 23, an antenna being provided with a single antenna port 1 comprises two array elements arranged on an antenna surface. Feeding points are indicated with reference to the index of groups in FIG. 1.

The antenna configuration may be realized by two array elements arranged beside each other. A first array element having a first feeding point "A" associated with the first polarization and a second feeding point "B" with the second polarization, and a second array element having a first feeding point "C" associated with the first polarization and a second feeding point "D" associated with the second polarization. For each array element, the phase centres for the different polarizations may be considered to be arranged in the same column.

The same antenna configuration may be realized by two array elements superimposed on each other. A first array element having a first feeding point "A" associated with the first polarization and a second feeding point "D" with the second polarization, and a second array element having a first feeding point "C" associated with the first polarization and a second feeding point "B" associated with the second polarization. For each array element, the phase centres for the different polarizations may be considered to be arranged in different columns.

An array element may also comprise a plurality of radiating elements interconnected via a feeding network to a common feeding point for each polarization. An example of this is described in FIG. 24.

The antenna comprises twelve dual polarized radiating elements arranged in two columns. The radiating elements are connected to two antenna ports 1 and 2 via a beam forming network, such as disclosed in connection with FIG. 13 or 18. Feeding points are indicated with reference to the index of groups in FIG. 11.

This antenna configuration has previously been described in connection with FIG. 11-13, but may be realized in many different ways. In FIG. 24 an alternative is presented comprising four array elements, which are superimposed to realize the antenna configuration. A first array element having a first feeding point "A" associated connected to every second radiation elements in the first column with the first polarization and a second feeding point "F" connected to every second radiation elements in the second column with the second polarization. Similarly, the second array element has feeding points D and G, the third array element has feeding points B and E, and the fourth array element has feeding points C and H.

In the above described embodiments, different polarizations have been exemplified as vertical and horizontal polarization created by a single polarized or a dual polarized array element. Radiating elements have been used to illustrate the simplest implementation and also to clearly describe the inventive concept. However, it should be noted that array elements having other polarizations, such as +45 degrees/−45 degrees, or +60 degrees/−30 degrees, may be used as long as the difference between the two polarizations are more or less 90 degrees (i.e. essentially orthogonal). Furthermore, it is even conceivable to have array elements with 0/+90 degrees polarizations in a first column and array elements with −20/+70 in a second column. In that case it is necessary to adapt the feeding of the array elements in such a way that the polarizations of all array elements arranged in different columns are the same. This may be achieved by applying a polarization transformer directly to the array element ports to make all array element have the same polarizations. The polarization transformer is preferably viewed as being a part of the array element, and then the polarizations will be identical for all array elements.

Figure 25:
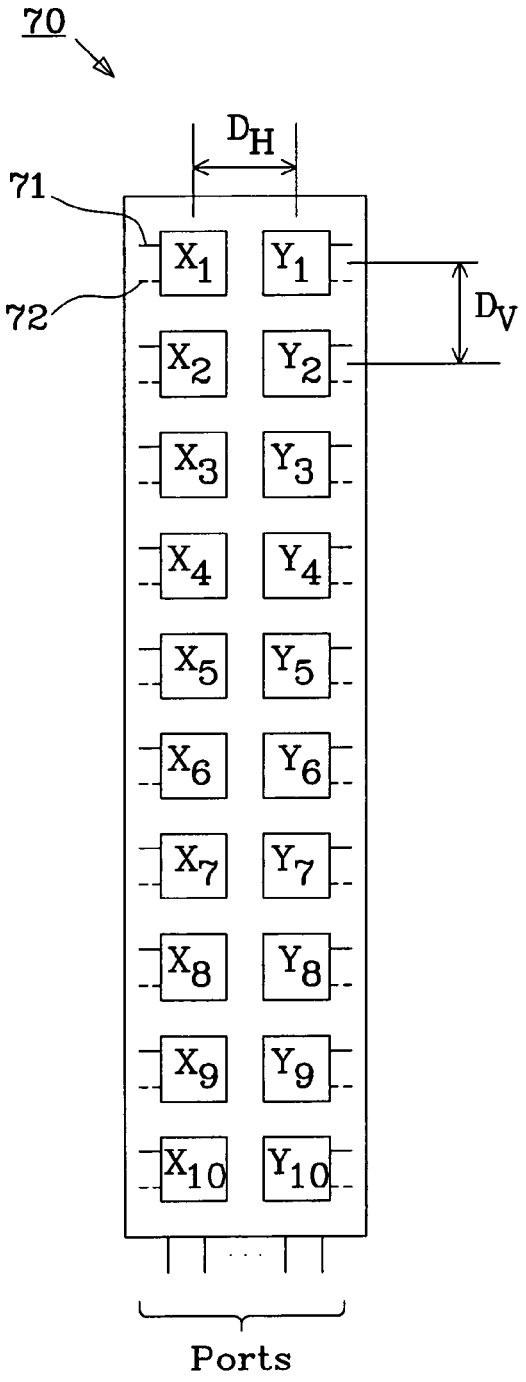
FIG. 25 shows a generic antenna configuration that may be used to implement the present invention.

FIG. 25, in connection with FIGS. 26*a*-26*d* will also illustrate possibilities to use other configurations of array elements and still obtain an antenna with the same properties as described above.

FIG. 25 shows a generic antenna configuration 70 with array elements arranged in two columns. Each column comprises ten array elements. Array elements $X_1$-$X_{10}$ are arranged in a first column and array elements $Y_1$-$Y_{10}$ are arranged in a second column. Each array element is in this generic example dual-polarized and has a first feeding point 71 (illustrated by a continuous line) and a second feeding point 72 (illustrated by a broken line). Radiating elements within an array element with a first polarization is connected to the first feeding point 71 and radiating elements with a second polarization, orthogonal to the first polarization, is connected to the second feeding point 72.

The feeding points of the array elements $X_1$-$X_{10}$ are connected to a number of ports via distribution networks (not shown). The feeding points of the array elements $Y_1$-$Y_{10}$ are connected to the same number of ports via distribution networks (not shown). The number of ports depends on how many array elements are included in a group, as discussed above, if only two array elements with dual polarizations are included in a group, the feeding points of array elements in each column will be connected to two ports (see FIG. 1). However, if four array elements with dual polarizations are included in a group, the feeding points of array elements in each column will be connected to fours ports (see FIG. 11).

The horizontal distance $D_H$ between the columns and the vertical distance $D_V$ between each row are normally structural parameters determined when designing the multi beam antenna. These are preferably set to be between 0.3λ and 1λ. However, it is possible to design a multi beam antenna in which the horizontal distance and/or the vertical distance may be altered to change the characteristics of the multi beam antenna.

The array elements illustrated in FIG. 25 may be realized as a subarray having an n×m matrix of radiating elements, n and m are integers equal to or greater than 1 (n,m≥1). Each radiating element within each subarray is connected to the respective feeding point.

Figure 26A:
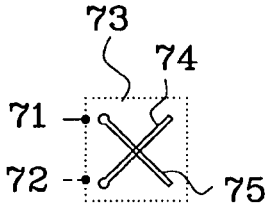
FIGS. 26*a*-26*d* show four alternative implementations of array elements.

FIGS. 26*a*-26*d* show four examples of array elements that may be used in the antenna illustrated in FIG. 25. All of the exemplified array elements comprise dual polarized radiating elements, and thus two feeding points 71 and 72. It should be noted that each one of the exemplified array elements may have single polarized radiating elements, as illustrated in connection with FIGS. 23 and 24. FIG. 26*a* illustrates a simple dual-polarized array element 73 having a first feeding point 71 connected to a first radiating element 74 (1×1 matrix) with a first polarization, and a second feeding point 72 connected to a second radiating element 75 with a second polarization, orthogonal to the first polarization.

Figure 26B:
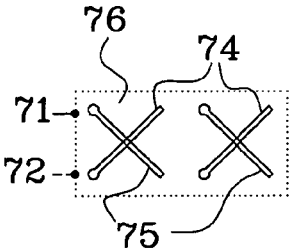

FIG. 26*b* illustrates a dual-polarized array element 76 having a first feeding point 71 connected to a 2×1 matrix of first radiating elements 74 with a first polarization, and a second feeding point 72 connected to a 2×1 matrix of second radiating elements 75 with a second polarization, orthogonal to the first polarization.

Figure 26C:
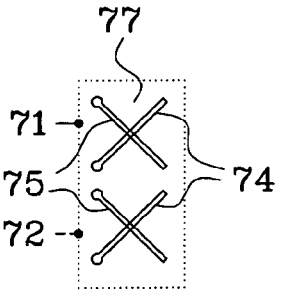

FIG. 26*c* illustrates a dual-polarized array element 77 having a first feeding point 71 connected to a 1×2 matrix of first radiating elements 74 with a first polarization, and a second feeding point 72 connected to a 1×2 matrix of second radiating elements 75 with a second polarization, orthogonal to the first polarization.

Figure 26D:
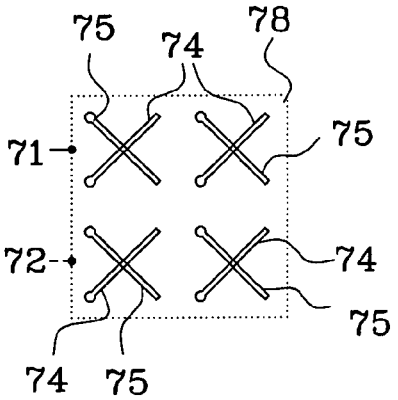

FIG. 26*d* illustrates a dual-polarized array element 78 having a first feeding point 71 connected to a 2×2 matrix of first radiating elements 74 with a first polarization, and a second feeding point 72 connected to a 2×2 matrix of second radiating elements 75 with a second polarization, orthogonal to the first polarization.

All array elements in the generic antenna configuration described in FIG. 25 may for instance have the same type of dual-polarized array element 77, but is naturally possible that every array element in the antenna configuration is different. The important feature is that the array element is provided with two feeding points, associated with orthogonal polarizations, and that the phase centres associated with each polarization are arranged in at least two columns as described above.

EXAMPLE 5

Figure 27:
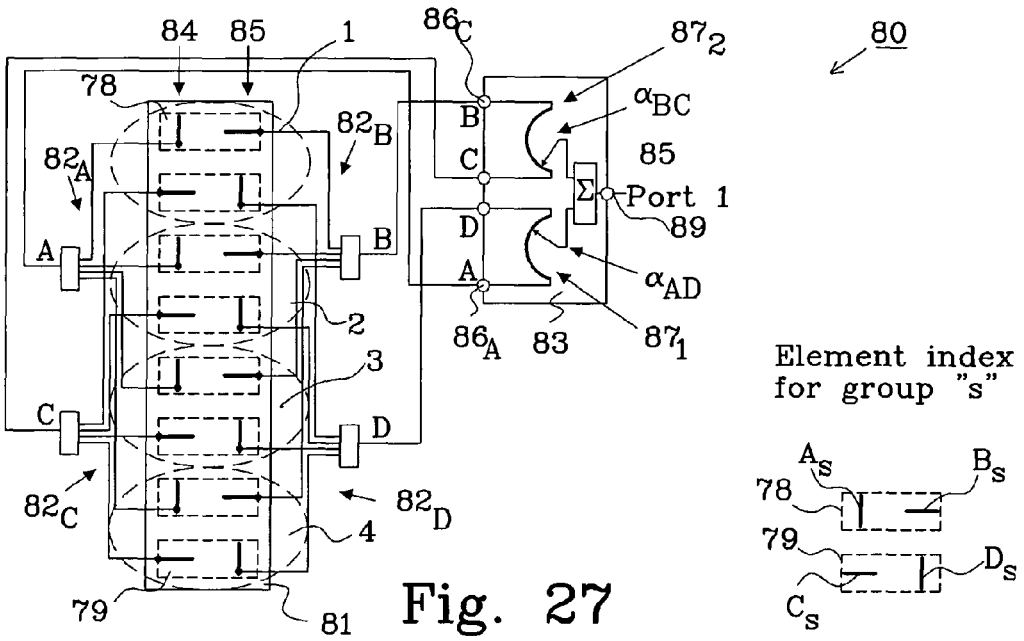
FIG. 27 shows a third single beam antenna according to the invention.

FIG. 27 shows a third single beam antenna 80, according to the invention, comprising an antenna configuration 81, four distribution networks $\mathbf{82}_A$-$\mathbf{82}_D$ and a beam forming network 83. The antenna comprises one column of eight interleaved array elements of two different types 78 and 79. Each array element has a first feeding point (and first phase centre) associated with a first polarization and a second feeding point (and second phase centre) associated with a second polarization, orthogonal to the first polarization. The first phase centre of the first type of array elements 78 are arranged in a first column and the first phase centre of the second array elements 79 are arranged in a second column. The opposite applies for the second phase centres of the first type 78 and second type 79 of array elements. Each distribution network is configured to connect each respective feeding point of the same type of array elements to a port (A-D), and through the beam forming network 83 connect the ports (A-D) to a single antenna port 1.

In this example, the array elements are divided into four groups 1-4 and each array element comprises two single-polarized radiating elements, each connected to a respective feeding point. Each group "s" comprises the first type of array element 78 having a vertically polarized radiating element $A_s$ and a horizontally polarized radiating element $B_s$, and the second type of array element 79 having a horizontally polarized radiating element $C_s$ and a vertically polarized radiating element $D_s$. The phase centres of the radiating elements $A_s$ and $C_s$ are arranged in a first column 84 and the phase centres of the radiating elements $B_s$ and $D_s$ are arranged in a second column 85. The vertical radiating elements in the first column 84, i.e. $A_1$-$A_4$, are connected to port A through a first distribution network $\mathbf{82}_A$, and the horizontal radiating elements in the first column 84, i.e. $C_1$-$C_4$, are connected to port C through a second distribution network $\mathbf{82}_C$. The same applies to radiating elements in the second column 85, i.e. radiating elements $B_1$-$B_4$ are connected via a third distribution network to port B and radiating elements $D_1$-$D_4$ are connected via a fourth distribution network to port D. The distribution networks are preferably implemented as separate elevation beam-forming networks.

The four ports, Port A-Port D, are combined to one antenna port, Port 1, by the beam forming network 83. The beam forming network 83 is provided with a primary connection 89 intended to be connected to antenna port 1 and four secondary connections $\mathbf{86}_A$-$\mathbf{86}_D$. Each port A, B, C and D are connected to a respective secondary connection of the beam forming network 83. The vertical polarized linear array corresponding to Port A of the first column 84 and the vertical polarized linear array corresponding to Port D of the second column 85 are connected via a first integrated power combiner/splitter and phase shifting device $\mathbf{87}_1$ (similar to that described in connection with FIG. 4). The horizontal polarized linear array corresponding to Port C of the first column 84 and the horizontal polarized linear array corresponding to Port B of the second column 85 are connected via a second integrated power combiner/splitter and phase shifting device $\mathbf{87}_2$. The combined ports AD and BD are then connected via a primary power combiner/splitter 88, combining/splitting the power between radiating elements having different polarization, to the antenna Port 1.

EXAMPLE 6

Figure 28:
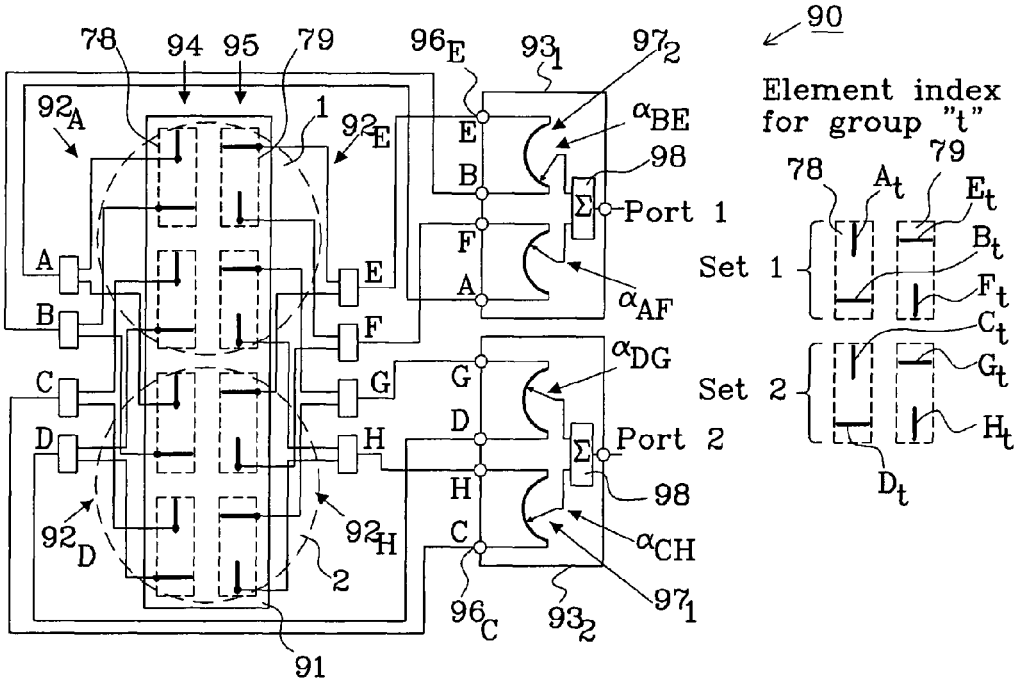
FIG. 28 shows a third dual beam antenna according to the invention.

FIG. 28 shows a third dual beam antenna 90, according to the invention, comprising an antenna configuration similar to that described in FIG. 27 with the exception that the array elements are vertically oriented and the first type of array elements 78 are arranged in a first column 94 and the second type of array elements 79 are arranged in a second column 95. The array elements are divided into only two groups, each group "t" having four array elements. The single-polarized radiating elements $A_t$, $B_t$, $E_t$ and $F_t$ belong to a first set and the single-polarized radiating elements $C_t$, $D_t$, $G_t$ and $H_t$ belong to a second set. Observe that the first phase centre and the second phase centre of the first type of array elements 78 are arranged in the first column 94, and that the first phase centre and the second phase centre of the second type of array elements 79 are arranged in the second column 95.

Eight ports, Port A-Port H, are combined to two antenna ports, Port 1 and Port 2, by two beam forming networks $\mathbf{93}_1$ and $\mathbf{93}_2$. Each beam forming network is provided with a primary connection intended to be connected to the respective antenna port, and four secondary connections. Each port A-H are connected to a respective secondary connection of the beam forming networks. The respective feeding point of every second array element in each column is connected via a separate distribution network $\mathbf{92}_A$-$\mathbf{92}_H$, which preferably is implemented as an elevation beam forming network, to ports A-H, see FIG. 28.

Four ports A, B, E and F are connected to a first beam forming network $\mathbf{93}_1$. The vertical polarized array corresponding to port A of a first column 94 and the vertical polarized linear array corresponding to port F of the second column 95 are connected via a first phase shifting network comprising a first integrated power combiner/splitter and phase shifting device $\mathbf{97}_1$ (similar to that described in connection with FIG. 4). The horizontal polarized linear array corresponding to Port B of the first column 94 and the horizontal polarized linear array corresponding to Port E of the second column 95 are connected via a second phase shifting network comprising a second integrated power combiner/splitter and phase shifting device $\mathbf{97}_2$. The combined ports AF and BE are then connected via a primary power combiner/splitter $\mathbf{98}_1$, combining/splitting the power between radiating elements belonging to the first set and having different polarization, to the antenna Port 1.

Similarly, ports C, D, G and H are connected via a second beam forming network $\mathbf{93}_2$ to antenna port 2.

In all the above described embodiments, it is possible to implement electrical tilt, but there is no additional affect to the invention. Furthermore, the combiners/splitters described in connection with FIGS. 3, 4, 13, 18, 20, 27 and 28 may have variable (or at least fixed non-equal power division). A non-equal combination/spilt may be implemented both for the primary and secondary combiners/splitters, but is more advantageous for the primary combiner/splitter.

Each feeding network described in connection with the embodiments above comprises a beam forming network and multiple distribution networks. Each distribution network exclusively connects a respective secondary connection of the beam forming network to the first feeding points of the connected array elements with the first phase centre arranged in a respective column, or exclusively connects a respective secondary connection of the beam forming network to the second feeding points of the connected array elements with the second phase centre arranged in a respective column.

The invention claimed is:

1. An antenna with adjustable beam characteristics comprising:

an antenna configuration comprising multiple array elements, one or more antenna ports, and a distribution network, wherein the multiple array elements comprises:

respective first feeding points associated with a first polarization and respective second feeding points associated with a second polarization, orthogonal to said first polarization, the multiple array elements further having respective first phase centres associated with the first polarization and respective second phase centres associated with the second polarization, wherein the first phase centres are arranged in at least two columns and the second phase centres are arranged in the at least two columns, and wherein said multiple array elements are arranged in at least two groups of array elements, each of said at least two groups comprising at least two array elements, wherein each of the one or more antenna ports is connected to the first feeding points and the second feeding points of at least two of the array elements, wherein the first phase centres and the second phase centres are arranged in said at least two columns via a feeding network, the feeding network comprising a beam forming network and a plurality of distribution networks, the beam forming network having:

a primary connection, connected to a respective one of the one or more antenna ports, and at least four secondary connections, wherein said beam forming network further comprises:

a power combiner/splitter configured to divide power between the first feeding points associated with the first polarization and the second feeding points associated with the second polarization, and a phase shifting device configured to:

control phase shift differences between i) the first phase centres of the first feeding points of the array elements in one of at least two columns with ii) the first phase centres of the first feeding points of the array elements in a different one of the at least two columns and control phase shift differences between i) the second phase centres of the second feeding points of the array elements in one of the at least two columns with ii) the second phase centres of the second feeding points of the array elements in a different one of the at least two columns, and wherein each of said distribution networks is arranged to perform at least one of the following:

connect a respective one of the at least four secondary connections of said beam forming network to the first feeding points of the at least two groups of array elements, connect another respective one of the at least four secondary connections of said beam forming network to the second feeding points of said the at least two groups of array elements.

2. The antenna according to claim 1, wherein the first phase centres and the second phase centres of at least one array element are arranged in two columns.

3. The antenna according to claim 1, wherein the first phase centres and the second phase centres of at least one array element are arranged in the same column.

4. The antenna according to claim 1, wherein a first distance between the first phase centres arranged in different columns is greater than 0.3 wavelengths; and a second distance between the second phase centres arranged in different columns is greater than 0.3 wavelengths.

5. The antenna according to claim 1, wherein said multiple array elements comprise at least a first set and a second set, each set comprising a subset of multiple array elements, the first phase centres and the second phase centres of the first set of array elements and the first phase centres and the second phase centres of the second set of array elements are arranged in each of said at least two columns, respectively; wherein said antenna further comprises at least two antenna ports, each being connected to array elements in the first set and second set, respectively, via feeding networks.

6. The antenna according to claim 5, wherein the array elements are arranged in columns and each column comprises array elements of said first set interleaved with array elements of said second set.

7. The antenna according to claim 5, wherein said array elements are arranged in multiple rows, each row comprises array elements of said first set interleaved with array elements of said second set.

8. The antenna according to claim 5, wherein said array elements are arranged in multiple rows, each row comprises array elements of said first set superimposed with array elements of said second set.

9. The antenna according to claim 1, wherein said array elements are arranged in at least three columns, each beam forming network further comprising at least six secondary connections.

10. The antenna according to claim 1, wherein the power combiner/splitter in the beam forming network is a primary power combiner/splitter connected to the respective antenna port and configured to divide the power between the first feeding point and the second feeding point of connected array elements.

11. The antenna according to claim 1, wherein the phase shifting device of the beam forming network comprises two phase shifting networks, including i) a first phase shifting network configured to control the phase shift difference and further split power between the first feeding point of connected array elements with the first phase centre arranged in different columns and ii) a second phase shifting network configured to control phase shift difference and further split power between the second feeding point of connected array elements with the second phase centre arranged in different columns.

12. The antenna according to claim 11, wherein each phase shifting network comprises an integrated phase shifting and power splitting device.

13. The antenna according to claim 11, wherein each phase shifting network comprises a secondary power combiner/splitter configured to feed the first feeding point or the second feeding point of connected array elements having the first phase centre or a second phase centre, respectively, arranged in the same column via a phase shifter.

14. The antenna according to claim 1, wherein each of the plurality of distribution networks is configured to exclusively connect a respective secondary connection of the beam forming network to the first feeding points of the connected array elements with the first phase centres arranged in a respective column, or to exclusively connect a respective secondary connection of the beam forming network to the second feeding points of the connected array elements with the second phase centres arranged in a respective column.

15. The antenna according to claim 14, wherein the beam forming network further is configured to perform azimuth beam forming and each distribution network further is configured to perform elevation beam forming.

16. The antenna according to claim 1, wherein an output of the phase shifting device is arranged to be an input into the power combiner/splitter.

17. The antenna according to claim 1, wherein said antenna is capable of said adjustable beam characteristics without mechanically rotating or moving parts.

18. An antenna with adjustable beam characteristics comprising:

first, second, third, and fourth distribution networks coupled respectively to first, second, third, and fourth ports;

a plurality of antenna groups, each antenna group comprising first, second, third, and fourth radiating elements, each radiating element having first and second feeding points, wherein for each antenna group, each respective radiating element is connected by said respective feeding point via said respective distribution network to said respective port and wherein said first and third radiating elements of said antenna groups have a first polarization and form a first column and said second and fourth radiating elements of said antenna groups have a second polarization orthogonal to said first polarization and form a second column;

a beam forming network combining said first, second, third, and fourth ports into a first antenna port, said beam forming network having a primary connection connected to said first antenna port and first, second, third, and fourth secondary connections respectively connected to said first, second, third, and fourth ports;

a first phase-shifting network comprising a first power combiner/splitter configured to split power between said first and second columns, and first and third variable phase shifters configured to apply respective phase shifts, wherein said first variable phase shifter is connected via said first secondary connection to said first radiating element of said antenna groups and said third variable phase shifter is connected via said third secondary connection to said third radiating element of said antenna groups;

a second phase-shifting network comprising a second power combiner/splitter configured to split power between said first and second columns, and second and fourth variable phase shifters configured to apply respective phase shifts, wherein said second variable phase shifter is connected via said second secondary connection to said second radiating element of said antenna groups and said fourth variable phase shifter is connected via said fourth secondary connection to said fourth radiating element of said antenna groups; and a primary power combiner/splitter connected to said first and second power combiner/splitters and to said first antenna port and configured to split power between radiating elements having different polarization.

19. An antenna, comprising:

a first column of N antenna elements, each antenna element in the first column of antenna elements comprising a radiating element associated with a first polarization and a radiating element associated with a second polarization; and a second column of N antenna elements, each antenna element in the second column of antenna elements comprising a radiating element associated with a first polarization and a radiating element associated with a second polarization;

a first distribution network;

a second distribution network;

a third distribution network;

a fourth distribution network; and a beam forming network comprising:

a primary connection, a first secondary connection, a second secondary connection, a third secondary connection, a fourth secondary connection, a splitter, a first phase shifting network, and a second phase shifting, said splitter comprising: i) a first connection connected to the primary connection, 2) a second connection connected to the first and second secondary connections via the first phase shifting network, and 3) a third connection connected to the third and fourth secondary connections via the second phase shifting network, wherein each radiating element in said first group that is associated with the first polarization is electrically connected to the first secondary connection via the first distribution network, each radiating element in said second group that is associated with the first polarization is electrically connected to the second secondary connection via the second distribution network, each radiating element in said first group that is associated with the second polarization is electrically connected to the third secondary connection via the third distribution network, each radiating element in said second group that is associated with the second polarization is electrically connected to the fourth secondary connection via the fourth distribution network, said first phase shifting network is configured to: receive a signal from the splitter via the second connection of the splitter, provide the signal to the first distribution network via the first secondary connection, and provide the signal to the second distribution network via the second secondary connection, wherein the signal provided to the first distribution network via the first secondary connection is phase shifted with respect to the signal provided to the second distribution network via the second secondary connection, and said second phase shifting network is configured to: receive a signal from the splitter via the third connection of the splitter, provide the signal to the third distribution network via the third secondary connection, and provide the signal to the fourth distribution network via the fourth secondary connection, wherein the signal provided to the third distribution network via the third secondary connection is phase shifted with respect to the signal provided to the fourth distribution network via the fourth secondary connection.

* * * * *